US008506271B2

(12) United States Patent
Seibel et al.

(10) Patent No.: US 8,506,271 B2
(45) **Date of Patent: *Aug. 13, 2013**

(54) SCROLL MACHINE HAVING AXIALLY BIASED SCROLL

(75) Inventors: Stephen M. Seibel, Celina, OH (US); Robert C. Stover, Versailles, OH (US); Masao Akei, Miamisburg, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/206,669

(22) Filed: Aug. 10, 2011

(65) Prior Publication Data

US 2011/0293456 A1 Dec. 1, 2011

Related U.S. Application Data

(63) Continuation of application No. 12/355,206, filed on Jan. 16, 2009, now Pat. No. 8,025,492.

(60) Provisional application No. 61/021,410, filed on Jan. 16, 2008.

(51) Int. Cl.

| | |
|---|---|
| ***F01C 1/02*** | (2006.01) |
| ***F01C 1/063*** | (2006.01) |
| ***F04C 2/00*** | (2006.01) |

(52) U.S. Cl.

USPC ..... 418/55.4; 418/55.1; 418/55.5

(58) Field of Classification Search

USPC ..... 418/55.4, 55.5, 55.1

See application file for complete search history.

(56) References Cited

U.S. PATENT DOCUMENTS

| | | | |
|---|---|---|---|
| 5,336,058 | A | 8/1994 | Yokoyama |
| 6,027,317 | A | 2/2000 | Barthod et al. |
| 6,679,683 | B2 * | 1/2004 | Seibel et al. ..... 418/55.4 |
| 6,773,242 | B1 | 8/2004 | Perevozchikov |
| 6,984,115 | B1 | 1/2006 | Tarng et al. |
| 7,140,851 | B2 | 11/2006 | Tarng |
| 7,207,787 | B2 | 4/2007 | Liang et al. |
| 7,338,265 | B2 | 3/2008 | Grassbaugh et al. |
| 7,967,582 | B2 | 6/2011 | Akei et al. |
| 7,967,583 | B2 | 6/2011 | Stover et al. |
| 7,972,125 | B2 | 7/2011 | Stover et al. |

(Continued)

OTHER PUBLICATIONS

International Search Report dated Aug. 27, 2009 regarding International Application No. PCT/US2009/031279.

Written Opinion of the International Searching Authority dated Aug. 27, 2009 regarding International Application No. PCT/US2009/031279.

International Preliminary Report on Patentability dated Jul. 20, 2010 regarding International Application No. PCT/US2009/031279.

(Continued)

*Primary Examiner* — Mary A Davis

(74) *Attorney, Agent, or Firm* — Harness, Dickey & Pierce, P.L.C.

(57) ABSTRACT

A compressor includes a shell, a compression mechanism, and an axial biasing system. The shell defines a first passage forming a first discharge passage. The compression mechanism includes first and second scroll members meshingly engaged with one another and forming a series of compression pockets. The first scroll member includes a second discharge passage. The axial biasing system includes a biasing member having first and second surfaces generally opposite one another. The first surface includes a first radial surface area exposed to an intermediate pressure from one of the compression pockets and a second radial surface area exposed to a discharge pressure. The second surface includes a third radial surface area exposed to the intermediate pressure. The biasing member is axially displaceable between first and second positions. The biasing member axially engages the first scroll member when in the first position.

27 Claims, 19 Drawing Sheets

(56) References Cited

U.S. PATENT DOCUMENTS

| | | | | |
|---|---|---|---|---|
| 7,976,295 | B2 | 7/2011 | Stover et al. | |
| 8,025,492 | B2 * | 9/2011 | Seibel et al. | 418/55.4 |
| 2007/0134117 | A1 * | 6/2007 | Liang et al. | 418/55.1 |
| 2008/0175737 | A1 | 7/2008 | Grassbaugh et al. | |
| 2010/0254841 | A1 | 10/2010 | Akei et al. | |

OTHER PUBLICATIONS

Chinese Office Action regarding Application No. 200980102281.9, dated Jun. 5, 2012. Translation provided by Unitalen Attorneys at Law.

South Korean Office Action regarding Application No. 10-2010-7017813, dated May 2, 2012. Translation provided by Y.S. Chang & Associates.

* cited by examiner

D3 2
D3 4
D3 3
D3 1
310
314
320
324
301
332
342
343
378
380
382
366
338
340
334
384
367
374
345
364
336
362
344
350
356
360
372
346
352
354
358
348
376
370
368
312
396
394
398
392
390
388

824
838
867
840
834
884
870
868
866
842
843
864
874
803
845
877
896
878
880
882
862
803
857
844
894
D8 2
D8 4
D8 3
D8 1
802
851
898
856
801
859
850
892
860
876
872
846
874
890
814
852
854
858
848
888
810

1124
1166
1138
1158
1140
1215
1143
1167
1183
1184
1187
1170
1168
1134
1220
1218
1228
1179
1142
1174
1222
1214
1224
1230
1178
1180
1164
1226
1196
1182
1162
1172
1145
1160
1212
1216
1193
1185
1194
1136
1210
D11 2
D11 4
D11 3
D11 1
1101
1198
1156
1151
1176
1192
1150
1186
1193
1146
1174
1210
1190
1148
1155
1181
1152
1114
1154
1153
1189
1188
1110

1124
1166
1138
1158
1140
1143
1174
1142
1224
1230
1178
1180
1182
1215
1162
1164
1167
1222
1214
1134
1183
1184
1187
1170
1168
1220
1218
1228
1179
1196
1226
1193
1194
1145
1160
1136
1172
1210
1212
1216
1185
1101
1198
1156
1151
1193
1176
1192
1150
1186
1146
1174
1210
1148
1181
1190
1152
1155
1114
1154
1153
1189
1188
1110
D11 2
D11 4
D11 3
D11 1

SCROLL MACHINE HAVING AXIALLY BIASED SCROLL

CROSS-REFERENCE TO RELATED APPLICATIONS

This application is a continuation of U.S. patent application Ser. No. 12/355,206 filed on Jan. 16, 2009 which claims the benefit of U.S. Provisional Application No. 61/021,410 filed on Jan. 16, 2008. The entire disclosure of each of the above applications are incorporated herein by reference.

FIELD

The present disclosure relates to compressors, and more specifically to compressor seal assemblies.

BACKGROUND

The statements in this section merely provide background information related to the present disclosure and may not constitute prior art.

A typical scroll compressor has first and second scrolls. In operation, the vanes of the first and second scrolls meshingly engage one another and form compression pockets. As these compression pockets capture and compress gas, they produce an axial separating force that urges the scrolls axially apart from one another. If the scrolls axially separate from one another, an internal leakage is formed between the compression pockets, causing inefficient compressor operation. An axial force may be applied to one of the scroll members to counter this axial separation. If the applied axial force is too great, however, the compressor may also run inefficiently. The axial force needed to prevent axial separation of the scrolls varies throughout compressor operation.

SUMMARY

This section provides a general summary of the disclosure, and is not a comprehensive disclosure of its full scope or all of its features.

A compressor may include a shell, a compression mechanism, and a seal assembly. The shell may define a first passage forming a first discharge passage. The compression mechanism may be supported within the shell and may include first and second scroll members meshingly engaged with one another and forming a series of compression pockets. The first scroll member may include a second passage extending therethrough defining a second discharge passage. The seal assembly may extend between the first scroll member and the shell and may form a sealed discharge path between the first and second passages. The seal assembly may include a first seal member axially displaceable between first and second positions relative to the shell and the first scroll member. The first seal member may axially abut the first scroll member when in the first position and may be free from axial contact with the first scroll member when in the second position. The seal assembly may maintain the sealed discharge path when the first seal member is in the first position.

An alternate compressor may include a shell, a compression mechanism, and a seal assembly. The shell may define a first passage forming a first discharge passage. The compression mechanism may be supported within the shell and may include first and second scroll members meshingly engaged with one another and forming a series of compression pockets. The first scroll member may include a second passage extending therethrough and defining a second discharge passage. The seal assembly may extend between the first scroll member and the shell. The seal assembly may include first and second annular seal members sealingly engaged with one another and forming a sealed discharge path between the first and second passages. Each of the first and second seal members may be axially displaceable relative to one another, the first scroll member, and the shell.

An alternate compressor may include a shell, a compression mechanism, and an axial biasing system. The shell may define a first passage forming a first discharge passage. The compression mechanism may be supported within the shell and may include first and second scroll members meshingly engaged with one another and forming a series of compression pockets. The first scroll member may include a second passage forming a second discharge passage extending therethrough. The axial biasing system may include a biasing member having first and second surfaces generally opposite one another. The first surface may include a first radial surface area exposed to an intermediate pressure from one of the compression pockets and a second radial surface area exposed to a discharge pressure. The second surface may include a third radial surface area exposed to the intermediate pressure. The biasing member may be axially displaceable between first and second positions relative to the shell and the first scroll member. The biasing member may axially engage the first scroll member when in the first position.

An alternate compressor may include a shell, a compression mechanism, and a valve actuation mechanism. The shell may define a discharge passage. The compression mechanism may be supported within the shell and may include first and second scroll members meshingly engaged with one another and forming a series of compression pockets. The first scroll member may include an end plate having a discharge passage extending therethrough and an aperture extending into one of the compression pockets. The valve actuation mechanism may be configured to open and close the aperture in the end plate of the first scroll member based on a force applied thereto by an intermediate pressure from another of the compression pockets and a force applied thereto by a discharge pressure.

Further areas of applicability will become apparent from the description provided herein. The description and specific examples in this summary are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
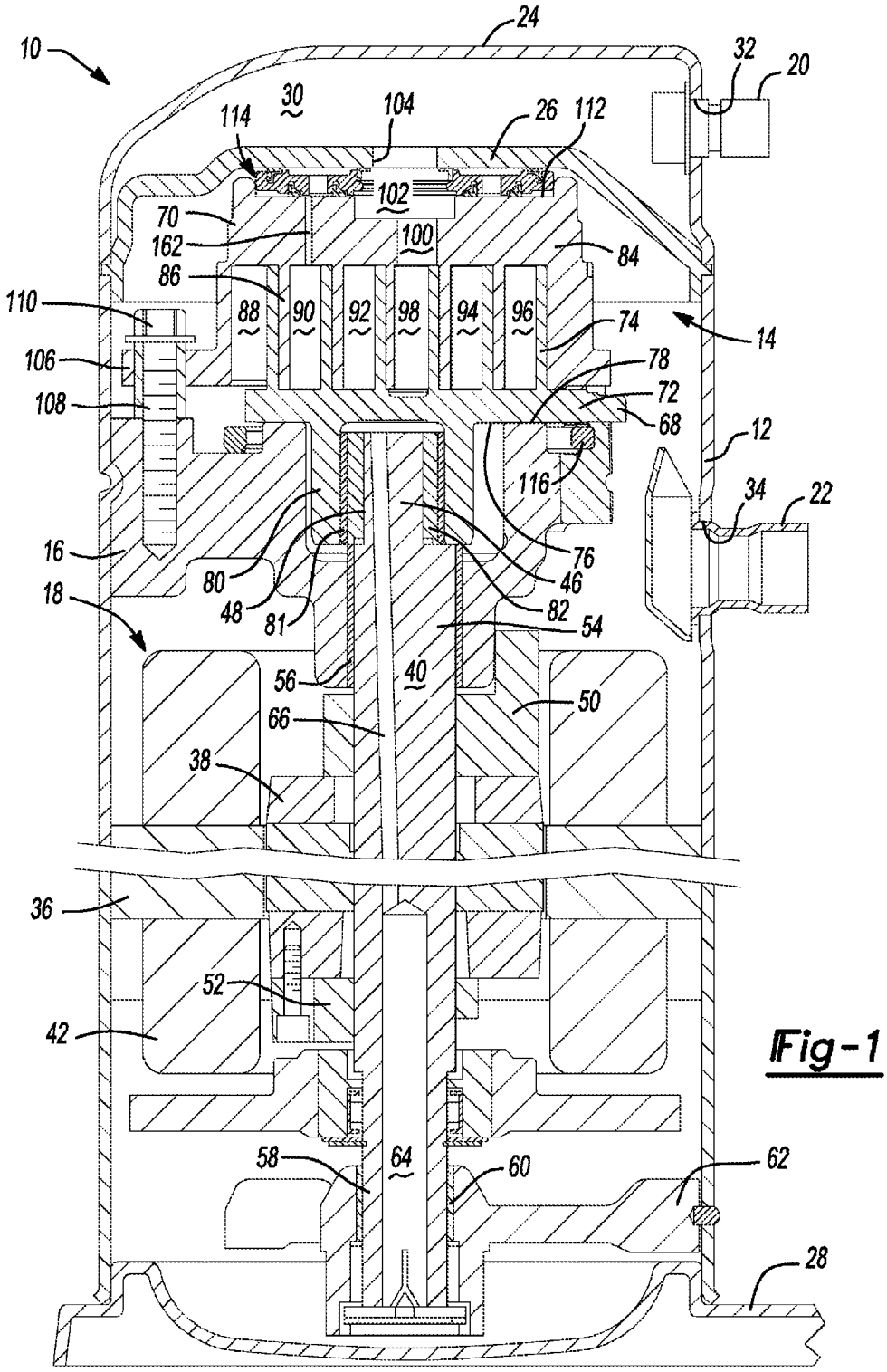
FIG. 1 is a sectional view of a compressor according to the present disclosure.

The following description is merely exemplary in nature and is not intended to limit the present disclosure, application, or uses. It should be understood that throughout the drawings, corresponding reference numerals indicate like or corresponding parts and features.

The present teachings are suitable for incorporation in many different types of scroll compressors, including hermetic machines, open drive machines and non-hermetic machines. For exemplary purposes, a compressor 10 is shown as a hermetic scroll refrigerant-compressor of the low-side type, i.e., where the motor and compressor are cooled by suction gas in the hermetic shell, as illustrated in the vertical section shown in FIG. 1.

With reference to FIG. 1, compressor 10 may include a cylindrical hermetic shell 12, a compression mechanism 14, a main bearing housing 16, a motor assembly 18, a refrigerant discharge fitting 20, and a suction gas inlet fitting 22. Hermetic shell 12 may house compression mechanism 14, main bearing housing 16, and motor assembly 18. Shell 12 may include an end cap 24 at the upper end thereof, a transversely extending partition 26, and a base 28 at a lower end thereof. End cap 24 and transversely extending partition 26 may generally define a discharge chamber 30. Refrigerant discharge fitting 20 may be attached to shell 12 at opening 32 in end cap 24. Suction gas inlet fitting 22 may be attached to shell 12 at opening 34. Compression mechanism 14 may be driven by motor assembly 18 and supported by main bearing housing 16. Main bearing housing 16 may be affixed to shell 12 at a plurality of points in any desirable manner, such as staking.

Motor assembly 18 may generally include a motor stator 36, a rotor 38, and a drive shaft 40. Motor stator 36 may be press fit into shell 12. Drive shaft 40 may be rotatably driven by rotor 38. Windings 42 may pass through stator 36. Rotor 38 may be press fit on drive shaft 40.

Drive shaft 40 may include an eccentric crank pin 46 having a flat 48 thereon and one or more counter-weights 50, 52. Drive shaft 40 may include a first journal portion 54 rotatably journaled in a first bearing 56 in main bearing housing 16 and a second journal portion 58 rotatably journaled in a second bearing 60 in lower bearing housing 62. Drive shaft 40 may include an oil-pumping concentric bore 64 at a lower end. Concentric bore 64 may communicate with a radially outwardly inclined and relatively smaller diameter bore 66 extending to the upper end of drive shaft 40. The lower interior portion of shell 12 may be filled with lubricating oil. Concentric bore 64 may provide pump action in conjunction with bore 66 to distribute lubricating fluid to various portions of compressor 10.

Compression mechanism 14 may generally include an orbiting scroll 68 and a non-orbiting scroll 70. Orbiting scroll 68 may include an end plate 72 having a spiral vane or wrap 74 on the upper surface thereof and an annular flat thrust surface 76 on the lower surface. Thrust surface 76 may interface with an annular flat thrust bearing surface 78 on an upper surface of main bearing housing 16. A cylindrical hub 80 may project downwardly from thrust surface 76 and may include a journal bearing 81 having a drive bushing 82 rotatively disposed therein. Drive bushing 82 may include an inner bore in which crank pin 46 is drivingly disposed. Crank pin flat 48 may drivingly engage a flat surface in a portion of the inner bore of drive bushing 82 to provide a radially compliant driving arrangement.

Non-orbiting scroll 70 may include an end plate 84 having a spiral wrap 86 on a lower surface thereof. Spiral wrap 86 may form a meshing engagement with wrap 74 of orbiting scroll 68, thereby creating an inlet pocket 88, intermediate pockets 90, 92, 94, 96, and an outlet pocket 98. Non-orbiting scroll 70 may have a centrally disposed discharge passageway 100 in communication with outlet pocket 98 and upwardly open recess 102 which may be in fluid communication with discharge muffler 30 via an opening 104 in partition 26. Non-orbiting scroll 70 may further include a radially outwardly extending flange 106 coupled to main bearing housing 16. More specifically, flange 106 may be fixed to main bearing housing 16 by bolt 108. Bolt 108 may fix non-orbiting scroll 70 from rotation but may allow axial displacement of non-orbiting scroll 70 relative to main bearing housing 16, shell 12, and orbiting scroll 68. Non-orbiting scroll 70 may be axially displaceable due to a clearance between an upper surface of flange 106 and a head 110 of bolt 108.

Non-orbiting scroll 70 may include a recess 112 in the upper surface thereof in which an annular floating seal assembly 114 is sealingly disposed for relative axial movement. Relative rotation of scrolls 68, 70 may be prevented by an Oldham coupling 116. Oldham coupling 116 may be positioned between and keyed to orbiting scroll 68 and main bearing housing 16 to prevent rotation of orbiting scroll 68.

Figure 2:
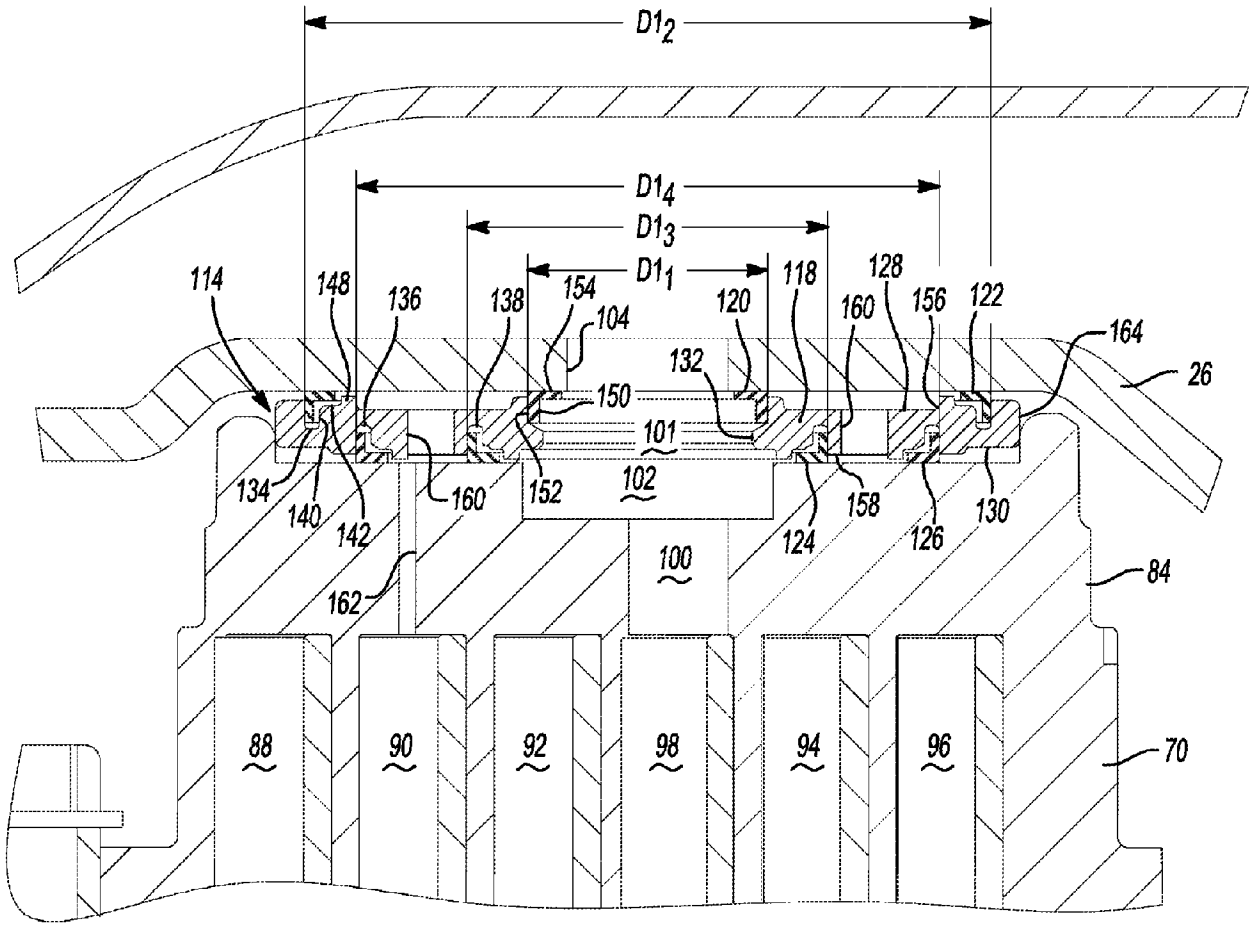
FIG. 2 is a fragmentary sectional view of the compressor of FIG. 1.

With additional reference to FIG. 2, annular floating seal assembly 114 may include an annular seal plate 118 and four annular lip seals 120, 122, 124, 126. Seal plate 118 may include first and second surfaces 128, 130 and discharge aperture 132 extending therethrough. First surface 128 may face a lower surface of partition 26. First surface 128 may include an annular recess 134 extending therein. Second surface 130 may include second and third annular recesses 136, 138 extending therein. Each of the first, second, and third recesses 134, 136, 138 may be generally similar to one another and therefore, only first recess 134 will be described in detail with the understanding that the description applies equally to second and third recesses 136, 138.

First recess 134 may include first and second portions 140, 142 forming a generally L-shaped cross-section. First portion 140 may form a first leg extending axially into first surface 128 and second portion 142 may form a second leg extending radially inwardly relative to first portion 140 and axially into first surface 128 a lesser extent than first portion 140. A support ring 148 may be disposed at a radially inner end of the second leg and may extend axially outwardly therefrom. Support ring 148 may prevent flattening of annular lip seal 122.

Each of annular lip seals 120, 122, 124, 126, which may be generally similar to one another, includes L-shaped cross sections. First annular lip seal 120 may be disposed within aperture 132 and may generally surround opening 104 in partition 26. An axially extending leg 150 of first lip seal 120 may sealingly engage a sidewall 152 of aperture 132 and a radially extending leg 154 of first lip seal 120 may sealingly engage a lower surface of partition 26. Second, third, and fourth annular lip seals 122, 124, 126 may be disposed in recesses 134, 138, 136, respectively. Second annular lip seal 122 may be sealingly engaged with first surface 128 of seal plate 118 and the lower surface of partition 26. Third and fourth annular lip seals 124, 126 may each be sealingly engaged with second surface 130 of seal plate 118 and an upper surface of end plate 84 of non-orbiting scroll 70. Third annular lip seal 124 may generally surround discharge passageway 100 in non-orbiting scroll 70.

The sealing engagement between first annular lip seal 120, partition 26, and seal plate 118 and the sealing engagement between third annular lip seal 124, non-orbiting scroll 70, and seal plate 118 may define a sealed discharge path 101. The sealing engagement between first and second annular lip seals 120, 122 and partition 26 and seal plate 118 may define a first sealed annular chamber 156. The sealing engagement between third and fourth annular lip seals 124, 126, non-orbiting scroll 70, and seal plate 118 may define a second sealed annular chamber 158.

First and second sealed annular chambers 156, 158 may be in fluid communication with one another through a series of apertures 160 extending through seal plate 118. A passage 162 may extend through end plate 84 of non-orbiting scroll 70 and into intermediate fluid pocket 90 and provide fluid communication between intermediate fluid pocket 90 and second sealed annular chamber 158. While shown extending into intermediate fluid pocket 90, it is understood that passage 162 may extend into any of intermediate fluid pockets 90, 92, 94, 96. As a result of apertures 160 in seal plate 118, intermediate fluid pocket 90 may also be in communication with first sealed annular chamber 156. As such, first and second sealed annular chambers 156, 158 may contain fluid at the same pressure as one another.

First annular lip seal 120 may define a first sealing diameter ($D1_1$), second annular lip seal 122 may define a second sealing diameter ($D1_2$), third annular lip seal 124 may define a third sealing diameter ($D1_3$), and fourth annular lip seal 126 may define a fourth sealing diameter ($D1_4$). The second sealing diameter may be greater than the fourth sealing diameter, the fourth sealing diameter may be greater than the third sealing diameter, and the third sealing diameter may be greater than the first sealing diameter ($D1_2>D1_4>D1_3>D1_1$).

In light of the relationship between the sealing diameters $D1_1$, $D1_2$, $D1_3$, $D1_4$, first surface 128 of seal plate 118 may define a first radial surface area ($A1_1$) between first and second sealing diameters ($D1_1$, $D1_2$) that is greater than a second radial surface area ($A1_2$) defined by second surface 130 of seal plate 118 between third and fourth sealing diameters ($D1_3$, $D1_4$). Each of the first and second radial surface areas ($A1_1$, $A1_2$) may be exposed to the intermediate fluid pressure ($P_i$) from intermediate fluid pocket 90. First surface 128 of seal plate 118 may define a third radial surface area ($A1_3$) between aperture 132 and first sealing diameter ($D1_1$) that is less than a fourth radial surface area ($A1_4$) defined by second surface 130 of seal plate 118 between aperture 132 and third annular lip seal 124. Each of the third and fourth radial surface areas ($A1_3$, $A1_4$) may be exposed to a discharge pressure ($P_d$) in the sealed discharge path 101. First surface 128 of seal plate 118 may define a fifth radial surface area ($A1_5$) between second sealing diameter ($D1_2$) and an outer circumference 164 of seal plate 118 that is less than a sixth radial surface area ($A1_6$) defined by second surface 130 of seal plate 118 between fourth sealing diameter ($D1_4$) and outer circumference 164 of seal plate 118. Each of the fifth and sixth radial surface areas ($A1_5$, $A1_6$) may be exposed to a suction pressure ($P_s$).

A radial surface area may generally be defined as the effective radial surface that fluid pressure acts upon to provide a force in the axial direction. The difference between radial surface areas on first and second surfaces 128, 130 of seal plate 118 may provide for displacement of seal plate 118 relative to partition 26 and non-orbiting scroll 70 during operation of compressor 10. More specifically, seal plate 118 may be displaceable between a first position where seal plate 118 contacts non-orbiting scroll 70 and exerts an axial force against non-orbiting scroll 70, urging non-orbiting scroll 70 toward orbiting scroll 68 and a second position where seal plate 118 is displaced axially from non-orbiting scroll 70 and toward partition 26. The axial force provided by seal plate 118 may be generated by fluid pressure acting thereon. The engagement between seal plate 118 and non-orbiting scroll 70 when seal plate 118 is in the first position may generally provide a biasing force in addition to the force normally applied to non-orbiting scroll 70 by fluid pressure acting directly thereon. This additional biasing force is removed from non-orbiting scroll 70 when seal plate 118 is in the second position.

As indicated below, $F1_1$ represents a force applied to first surface 128 of seal plate 118 and $F1_2$ represents a force applied to second surface 130 of seal plate 118.

$$F1_1=(A1_1)(P_i)+(A1_3)(P_d)+(A1_5)(P_s)$$

$$F1_2=(A1_2)(P_i)+(A1_4)(P_d)+(A1_6)(P_s)$$

When $F1_1>F1_2$, seal plate 118 may be displaced to the first position. When $F1_1<F1_2$, seal plate 118 may be displaced to the second position.

Figure 3:
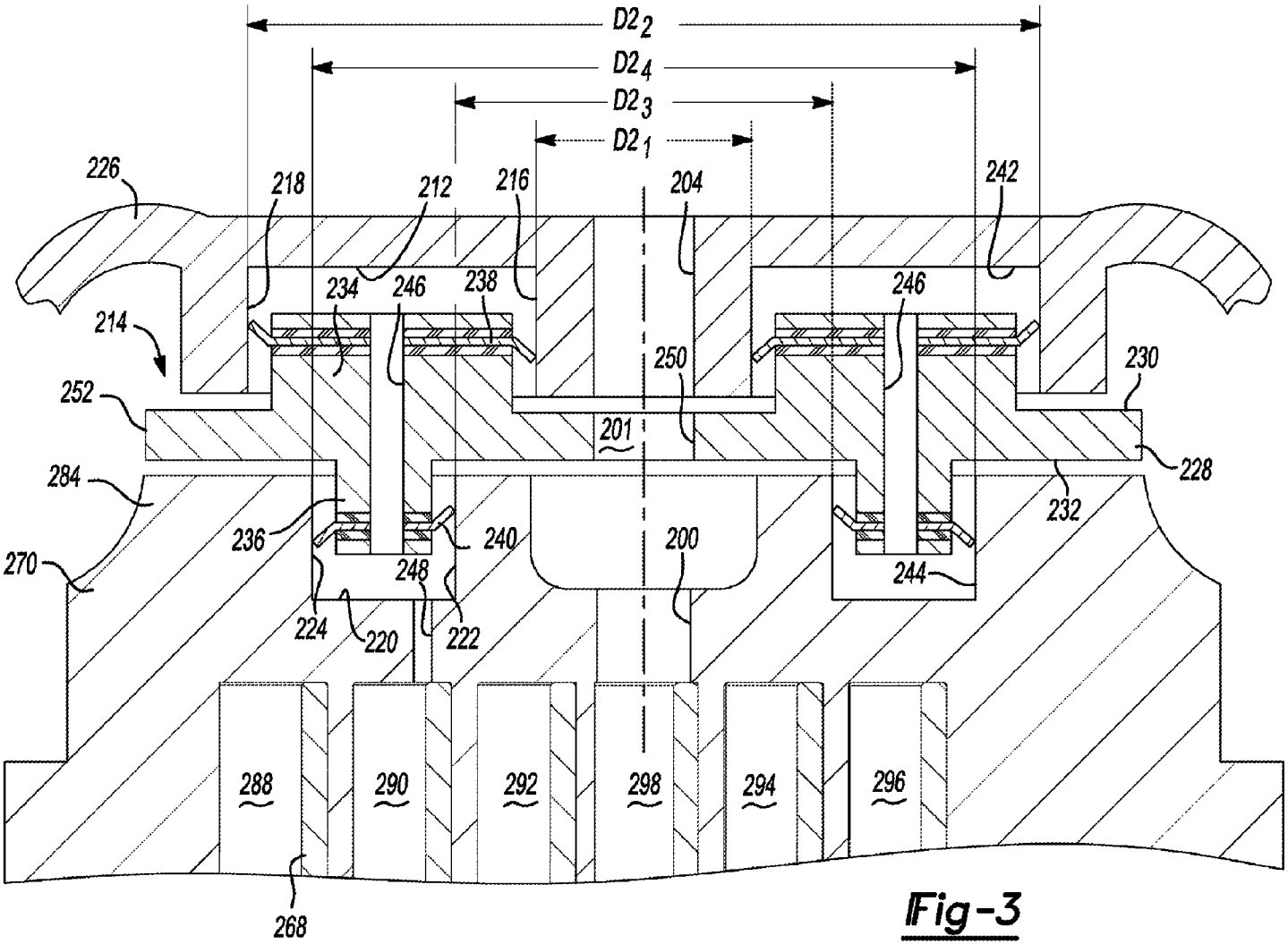
FIG. 3 is a fragmentary sectional view of another compressor according to the present disclosure.

With additional reference to FIG. 3, another partition 226 and non-orbiting scroll member 270 are shown having a sealing assembly 214 disposed therebetween. Partition 226 may include an annular channel 212 extending therefrom including inner and outer sidewalls 216, 218. Non-orbiting scroll 270 may include and annular channel 220 formed in an end plate 284 thereof and including inner and outer sidewalls 222, 224. Seal assembly 214 may be disposed between partition 226 and non-orbiting scroll 270.

Seal assembly 214 may include a seal plate 228 having first and second surfaces 230, 232. First surface 230 may include a first annular protrusion 234 extending axially outwardly therefrom and second surface 232 may include a second annular protrusion 236 extending axially outwardly therefrom. First annular protrusion 234 may include a first lip seal 238 disposed therein and second annular protrusion 236 may include a second lip seal 240 disposed therein. First annular protrusion 234 may be disposed in channel 212 and first lip seal 238 may be sealingly engaged with sidewalls 216, 218 thereof. Second annular protrusion 236 may be disposed in channel 220 in non-orbiting scroll 270 and second lip seal 240 may be sealingly engaged with sidewalls 222, 224 thereof.

Channels 212, 220 may generally surround opening 204 in partition 226 and discharge passageway 200 in non-orbiting scroll 270. As such, the sealing engagement between first lip seal 238 and inner sidewall 216 of partition 226 and the sealing engagement between second lip seal 240 and inner sidewall 222 of non-orbiting scroll 270 may define a sealed discharge path 201.

The sealing engagement between first lip seal 238 and inner and outer sidewalls 216, 218 of partition 226 may define a first sealed annular chamber 242 and the sealing engagement between second lip seal 240 and inner and outer sidewalls 222, 224 of non-orbiting scroll member 270 may define a second sealed annular chamber 244. First and second sealed annular chambers 242, 244 may be in communication with one another through one or more apertures 246 extending through seal plate 228 and first and second lip seals 238, 240. A passage 248 may extend through end plate 284 of non-orbiting scroll 270 and into intermediate fluid pocket 290 and provide fluid communication between intermediate fluid pocket 290 and second sealed annular chamber 244. While shown extending into intermediate fluid pocket 290, it is understood that passage 248 may extend into any of intermediate fluid pockets 290, 292, 294, 296. As a result of apertures 246 in seal plate 228, intermediate fluid pocket 290 may also be in communication with first sealed annular chamber 242. Thus, first and second sealed annular chambers 242, 244 may contain fluid at the same pressure as one another.

Inner sidewall 216 of annular channel 212 may define a first sealing diameter ($D2_1$) and outer sidewall 218 of annular channel 212 may define a second sealing diameter ($D2_2$). Inner sidewall 222 of annular channel 220 may define a third sealing diameter ($D2_3$) and outer sidewall 224 of annular channel 220 may define a fourth sealing diameter ($D2_4$). The second sealing diameter may be greater than the fourth sealing diameter, the fourth sealing diameter may be greater than the third sealing diameter, and the third sealing diameter may be greater than the first sealing diameter ($D2_2>D2_4>D2_3>D2_1$).

First surface 230 of seal plate 228 may define a first radial surface area ($A2_1$) between the first and second sealing diameters ($D2_1$, $D2_2$) that is greater than a second radial surface area ($A2_2$) define by the second surface 232 of seal plate 228 between the third and fourth sealing diameters ($D2_3$, $D2_4$). Each of the first and second radial surface areas ($A2_1$, $A2_2$) may be exposed to the intermediate fluid pressure ($P_i$) from intermediate fluid pocket 290.

In light of the relationship between the sealing diameters $D2_1$, $D2_2$, $D2_3$, $D2_4$, first surface 230 of seal plate 228 may further define a third radial surface area ($A2_3$) between the first sealing diameter ($D2_1$) and discharge aperture 250 in seal plate 228 that is less than a fourth radial surface area ($A2_4$) defined by second surface 232 of seal plate 228 between third sealing diameter ($D2_3$) and discharge aperture 250. Each of the third and fourth radial surface areas ($A2_3$, $A2_4$) may be exposed to a discharge pressure ($P_d$) in the sealed discharge path 201. First surface 230 of seal plate 228 may further include a fifth radial surface area ($A2_5$) defined between second sealing diameter ($D2_2$) and an outer circumference 252 of seal plate 228 that is less than a sixth radial surface area ($A2_6$) defined by second surface 232 of seal plate 228 between the fourth sealing diameter ($D2_4$) and outer circumference 252 of seal plate 228. Each of the fifth and sixth radial surface areas ($A2_5$, $A2_6$) may be exposed to a suction pressure ($P_s$).

The difference between radial surface areas on first and second surfaces 230, 232 of seal plate 228 exposed to intermediate, discharge, and suction pressures may provide for displacement of seal plate 228 relative to partition 226 and non-orbiting scroll 270 during compressor operation. More specifically, seal plate 218 may be displaceable between a first position where seal plate 218 contacts non-orbiting scroll 270 and exerts an axial force against non-orbiting scroll 270, urging non-orbiting scroll 270 toward orbiting scroll 268 and a second position where seal plate 218 is displaced axially from non-orbiting scroll 270 and toward partition 226. The axial force provided by seal plate 218 may be generated by fluid pressure acting thereon. The engagement between seal plate 218 and non-orbiting scroll 270 when seal plate 218 is in the first position may generally provide a biasing force in addition to the force normally applied to non-orbiting scroll 270 by fluid pressure acting directly thereon. This additional biasing force is removed from non-orbiting scroll 270 when seal plate 218 is in the second position.

As indicated below, $F2_1$ represents a force applied to first surface 230 of seal plate 228 and $F2_2$ represents a force applied to second surface 232 of seal plate 228.

$$F2_1=(A2_1)(P_i)+(A2_3)(P_d)+(A2_5)(P_s)$$

$$F2_2=(A2_2)(P_i)+(A2_4)(P_d)+(A2_6)(P_s)$$

When $F2_1>F2_2$, seal plate 228 may be displaced to the first position. When $F2_1<F2_2$, seal plate 228 may be displaced to the second position.

Figure 4:
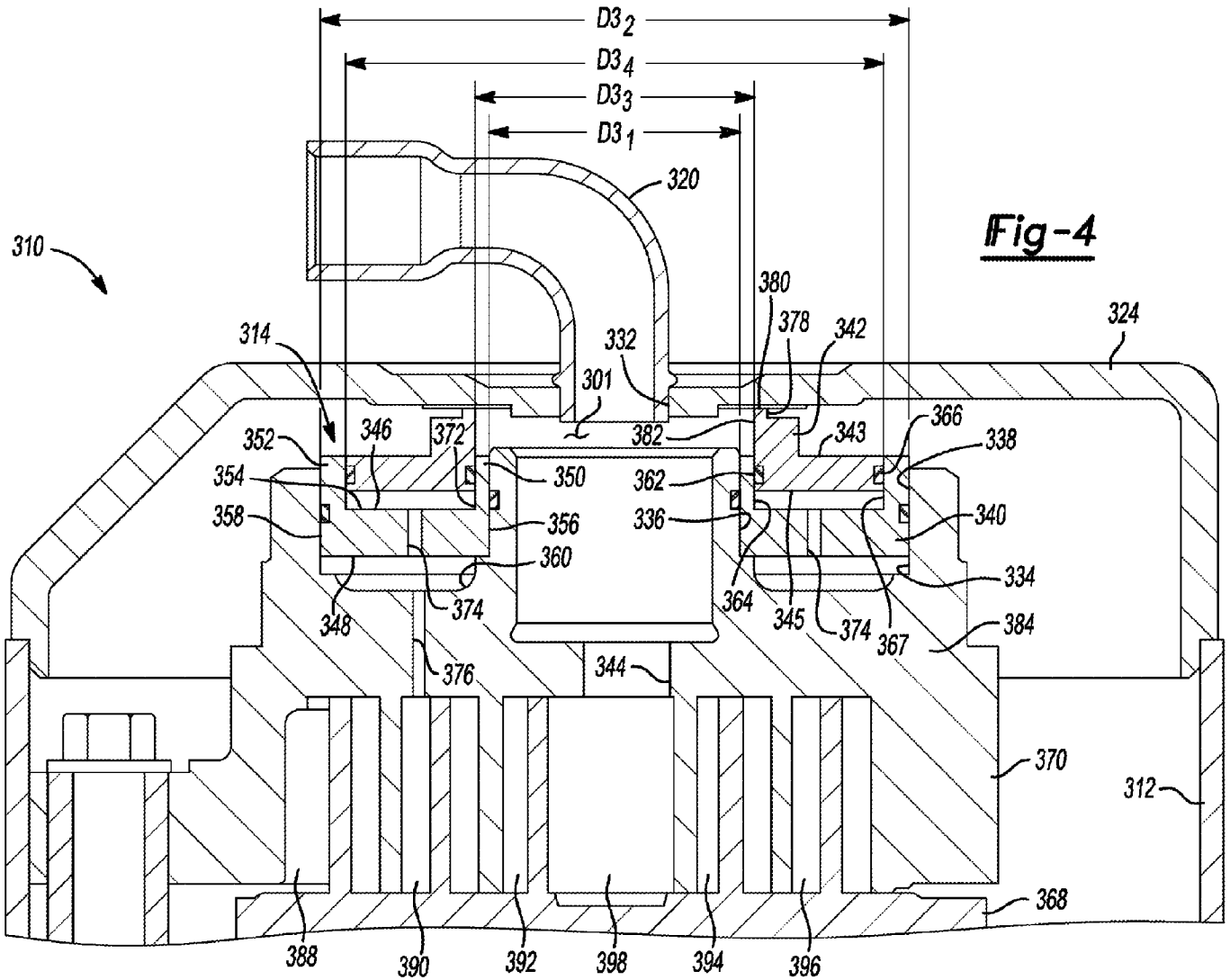
FIG. 4 is a fragmentary sectional view of another compressor according to the present disclosure.

Another compressor 310 is shown in FIG. 4. Compressor 310 may be generally similar to compressor 10, but may be a direct discharge compressor. Shell 312 may include an end cap 324 having a refrigerant discharge fitting 320 coupled to an opening 332 therein. Non-orbiting scroll 370 may include an annular channel 334 formed in an end plate 384 thereof and including inner and outer sidewalls 336, 338. A seal assembly 314 may be disposed between non-orbiting scroll 370 and end cap 324.

Seal assembly 314 may include first and second annular seals 340, 342. First and second annular seals 340, 342 may be disposed axially between end cap 324 and non-orbiting scroll 370 and may be axially displaceable relative to end cap 324, non-orbiting scroll 370, and one another. First annular seal 340 may be located axially between second annular seal 342 and non-orbiting scroll 370. First and second annular seals 340, 342 may generally surround opening 332 in end cap 324 and discharge passageway 344 in non-orbiting scroll 370. First annular seal 340 may sealingly engage inner sidewall 336 of channel 334 and second annular seal 342 may sealingly engage a lower surface of end cap 324, forming a sealed discharge path 301 between discharge passageway 344 and opening 332.

First annular seal 340 may include first and second surfaces 346, 348 generally opposite one another. First surface 346 may include first and second axially extending protrusions 350, 352 forming a channel 354 therebetween and second surface 348 may be generally planar. A radially inner surface 356 of first axially extending protrusion 350 may be sealingly engaged with inner sidewall 336 of channel 334 and a radially outer surface 358 of second axially extending protrusion 352 may be sealingly engaged with outer sidewall 338 of channel 334, forming a first sealed annular chamber 360 between first annular seal 340 and channel 334.

Second annular seal 342 may include first and second surfaces 343, 345 generally opposite one another. As discussed above, second annular seal 342 may be sealingly engaged with a lower surface of end cap 324 at a first end. More specifically, a portion of first surface 343 may sealingly engage end cap 324. A second end of second annular seal 342 may be disposed within channel 354 in first annular seal 340. A radially inner surface 362 of second annular seal 342 may be sealingly engaged with a radially outer surface 364 of first axially extending protrusion 350 and a radially outer surface 366 of second annular seal 342 may be sealingly engaged with a radially inner surface 367 of first annular seal 340, forming a second sealed annular chamber 372.

First annular seal 340 may include apertures 374 extending through first and second surfaces 346, 348 and providing fluid communication between first and second sealed annular chambers 360, 372. End plate 384 of non-orbiting scroll 370 may include a passage 376 extending into intermediate fluid pocket 390 and providing fluid communication between intermediate fluid pocket 390 and first sealed annular chamber 360. While shown extending into intermediate fluid pocket 390, it is understood that passage 376 may extend into any of intermediate fluid pockets 390, 392, 394, 396. As a result of apertures 374 in first annular seal 340, intermediate fluid pocket 390 may also be in fluid communication with second sealed annular chamber 372. As such, first and second sealed annular chambers 360, 372 may contain fluid at the same pressure as one another.

Inner sidewall 336 of channel 334 may define a first sealing diameter ($D3_1$) and outer sidewall 338 of channel 334 may define a second sealing diameter ($D3_2$). Radially outer surface 364 of first axially extending protrusion 350 may define a third sealing diameter ($D3_3$) and radially inner surface 367 of second axially extending protrusion 352 may define a fourth sealing diameter ($D3_4$). The second sealing diameter may be greater than the fourth sealing diameter, the fourth sealing diameter may be greater than the third sealing diameter, and the third sealing diameter may be greater than the first sealing diameter ($D3_2>D3_4>D3_3>D3_1$).

First surface 346 of first annular seal 340 may define a first radial surface area ($A3_1$) between the third and fourth sealing diameters ($D3_3$, $D3_4$) that is less than a second radial surface area ($A3_2$) defined by second surface 348 of first annular seal 340 between the first and second sealing diameters ($D3_1$, $D3_2$). Each of the first and second radial surface areas ($A3_1$, $A3_2$) may be exposed to the intermediate fluid pressure ($P_i$) from fluid pocket 390.

In light of the relationship between the sealing diameters $D3_1$, $D3_2$, $D3_3$, $D3_4$, first surface 346 of first annular seal 340 may further define third and fourth radial surface areas ($A3_3$, $A3_4$). The third radial surface area ($A3_3$) may be defined by first surface 346 of first annular seal 340 between the first and third sealing diameters ($D3_1$, $D3_3$) and fourth radial surface area ($A3_4$) may be defined between the second and fourth sealing diameters ($D3_2$, $D3_4$). The third radial surface area ($A3_3$) may be exposed to a discharge pressure ($P_d$) in the sealed discharge path 301 and the fourth radial surface area ($A3_4$) may be exposed to a suction pressure ($P_s$). The second radial surface area ($A3_2$) may be equal to the sum of the first, third, and fourth radial surface areas ($A3_1$, $A3_3$, $A3_4$). The first radial surface area ($A3_1$) may be greater than the fourth radial surface area ($A3_4$) and the fourth radial surface area ($A3_4$) may be greater than the third radial surface area ($A3_3$).

The difference between radial surface areas on first and second surfaces 346, 348 exposed to intermediate, discharge, and suction pressures may provide for displacement of first annular seal 340 relative to end cap 324, non-orbiting scroll 370, and second annular seal 342 during compressor operation. More specifically, first annular seal 340 may be displaceable between a first position where first annular seal 340 contacts non-orbiting scroll 370 and exerts an axial force against non-orbiting scroll 370, urging non-orbiting scroll 370 toward orbiting scroll 368 and a second position where first annular seal 340 is displaced axially from non-orbiting scroll 370 and toward end cap 324. The axial force provided by first annular seal 340 may be generated by fluid pressure acting thereon. The engagement between first annular seal 340 and non-orbiting scroll 370 when first annular seal 340 is in the first position may generally provide a biasing force in addition to the force normally applied to non-orbiting scroll 370 by fluid pressure acting directly thereon. This additional biasing force is removed from non-orbiting scroll 370 when first annular seal 340 is in the second position.

As indicated below, $F3_{1,1}$ represents a force applied to first surface 346 of first annular seal 340 and $F3_{1,2}$ represents a force applied to second surface 348 of first annular seal 340.

$$F3_{1,1}=(A3_1)(P_i)+(A3_3)(P_d)+(A3_4)(P_s)$$

$$F3_{1,2}=(A3_2)(P_i)$$

When $F3_{1,1}>F3_{1,2}$, first annular seal 340 may be displaced to the first position. When $F3_{1,1}<F3_{1,2}$, first annular seal 340 may be displaced to the second position.

Second annular seal 342 may define fifth and sixth radial surface areas ($A3_5$, $A3_6$) on first surface 343 and seventh radial surface area ($A3_7$) on second surface 345. The sum of the fifth and sixth radial surface areas ($A3_5$, $A3_6$) may be equal to the seventh radial surface area ($A3_7$). Fifth radial surface area ($A3_5$) may be defined between fourth sealing diameter ($D3_4$) and a radially outer surface 378 of a sealing portion 380 of second annular seal 342. The sixth radial surface area ($A3_6$) may be defined between radially outer surface 378 of sealing portion 380 and a radially inner surface 382 thereof. A diametrical midpoint between radially inner and outer surfaces 378, 382 may be greater than or equal to the third sealing diameter ($D3_3$). The fifth radial surface area ($A3_5$) may be exposed to a suction pressure ($P_s$) and sixth radial surface area ($A3_6$) may be exposed to a pressure that is generally the average of suction pressure ($P_s$) and discharge pressure ($P_d$) due to a pressure gradient across sixth radial surface area ($A3_6$). The seventh radial surface area ($A3_7$) may be defined between the third and fourth sealing diameters ($D3_3$, $D3_4$). The seventh radial surface area ($A3_7$) may be exposed to an intermediate fluid pressure ($P_i$) from intermediate fluid pocket 390.

The difference between radial surface areas exposed to intermediate, discharge and suction pressure may provide for axial displacement of second annular seal 342 relative to end cap 324, non-orbiting scroll 370, and first annular seal 340. Based on the pressure differential, second annular seal 342 may be displaced axially outwardly from end cap 324, allowing communication between the sealed discharge path 301 and suction pressure.

As indicated below, $F3_{2,1}$ represents a force applied to first surface 343 of second annular seal 342 and $F3_{2,2}$ represents a force applied to second surface 345 of second annular seal 342.

$$F3_{2,1}=(A3_5)(P_s)+(A3_6)(P_d+P_s)/2$$

$$F3_{2,2}=(A3_7)(P_i)$$

When $F3_{2,1}>F3_{2,2}$, second annular seal 342 may be displaced axially outwardly from end cap 324. When $F3_{2,1}<F3_{2,2}$, second annular seal 342 may be sealingly engaged with end cap 324.

Figure 5:
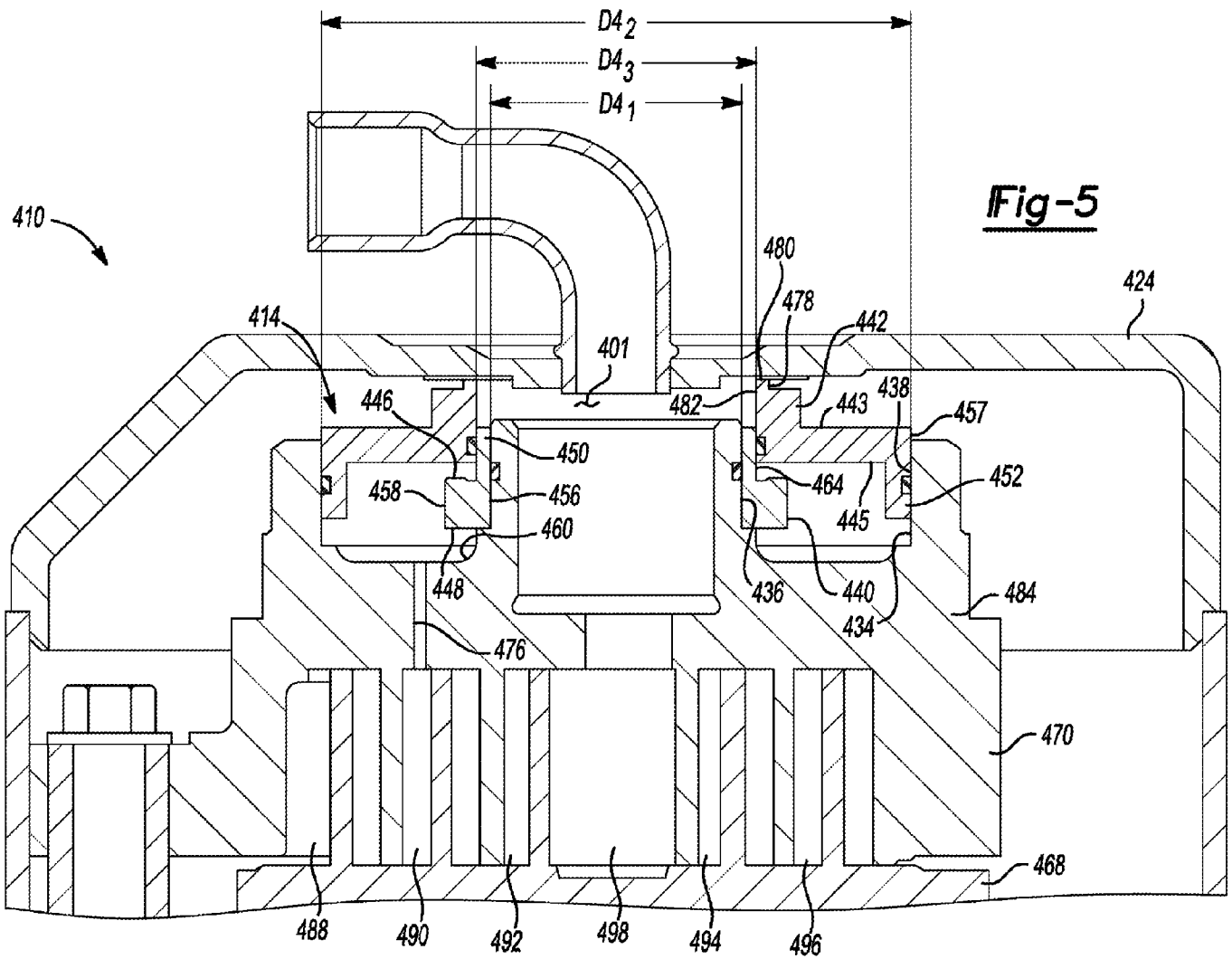
FIG. 5 is a fragmentary sectional view of another compressor according to the present disclosure.

With additional reference to FIG. 5, another seal assembly 414 is shown incorporated in compressor 410. Compressor 410 may be similar to compressor 310 with the exception of seal assembly 414. Seal assembly 414 may include first and second annular seals 440, 442.

First annular seal 440 may include first and second surfaces 446, 448 generally opposite one another. First surface 446 may include an axially extending protrusion 450 extending from a radially inner portion thereof and second surface 448 may be generally planar. A radially inner surface 456 of axially extending protrusion 450 may be sealingly engaged with inner sidewall 436 of channel 434.

Second annular seal 442 may include first and second surfaces 443, 445 generally opposite one another. Second annular seal 442 may be sealingly engaged with a lower surface of end cap 424 at a first end. More specifically, a portion of first surface 443 may sealingly engage end cap 424. Second surface 445 may include an axially extending protrusion 452 extending from a radially outer portion thereof. A radially outer surface 457 of axially extending protrusion 452 may sealingly engage outer sidewall 438 of channel 434, forming a sealed annular chamber 460 between first and second annular seals 440, 442 and channel 434.

End plate 484 of non-orbiting scroll 470 may include a passage 476 extending into intermediate fluid pocket 490 and providing fluid communication between intermediate fluid pocket 490 and sealed annular chamber 460. While shown extending into intermediate fluid pocket 490, it is understood that passage 476 may extend into any of intermediate fluid pockets 490, 492, 494, 496. Inner sidewall 436 of channel 434 may define a first sealing diameter ($D4_1$) and outer sidewall 438 of channel 434 may define a second sealing diameter ($D4_2$). Radially outer surface 464 of axially extending protrusion 450 may define a third sealing diameter ($D4_3$). The second sealing diameter may be greater than the third sealing diameter and the third sealing diameter may be greater than the first sealing diameter ($D4_2>D4_3>D4_1$).

First surface 446 of first annular seal 440 may define a first radial surface area ($A4_1$) between the third sealing diameter ($D4_3$) and a radially outer surface 458 thereof that is less than a second radial surface area ($A4_2$) that is defined by second surface 448 of first annular seal 440 between the first sealing diameter ($D4_1$) and radially outer surface 458. Each of the first and second radial surface areas ($A4_1$, $A4_2$) may be exposed to the intermediate fluid pressure ($P_i$) from intermediate fluid pocket 490.

In light of the relationship between the sealing diameters $D4_1$, $D4_2$, $D4_3$, first surface 446 of first annular seal 440 may further define a third radial surface area ($A4_3$) between the first and third sealing diameters ($D4_1$, $D4_3$). The third radial surface area ($A4_3$) may be exposed to a discharge pressure ($P_d$) in the sealed discharge path 401. The second radial surface area ($A4_2$) may be equal to the sum of the first and third radial surface areas ($A4_1$, $A4_3$).

The difference between first and second radial surface areas ($A4_1$, $A4_2$) exposed to intermediate pressure and the third radial surface area ($A4_3$) being exposed to discharge pressure may provide for displacement of first annular seal 440 relative to end cap 424, non-orbiting scroll 470, and second annular seal 442 during compressor operation. More specifically, first annular seal 440 may be displaceable between a first position where first annular seal 440 contacts non-orbiting scroll 470 and exerts an axial force against non-orbiting scroll 470, urging non-orbiting scroll 470 toward orbiting scroll 468 and a second position where first annular seal 440 is displaced axially from non-orbiting scroll 470 and toward end cap 424. The axial force provided by first annular seal 440 may be generated by fluid pressure acting thereon. The engagement between first annular seal 440 and non-orbiting scroll 470 when first annular seal 440 is in the first position may generally provide a biasing force in addition to the force normally applied to non-orbiting scroll 470 by fluid pressure acting directly thereon. This additional biasing force is removed from non-orbiting scroll 470 when first annular seal 440 is in the second position.

As indicated below, $F4_{1,1}$ represents a force applied to first surface 446 of first annular seal 440 and $F4_{1,2}$ represents a force applied to second surface 448 of first annular seal 440.

$$F4_{1,1}=(A4_1)(P_i)+(A4_3)(P_d)$$

$$F4_{1,2}=(A4_2)(P_i)$$

When $F4_{1,1}>F4_{1,2}$, first annular seal 440 may be displaced to the first position. When $F4_{1,1}<F4_{1,2}$, first annular seal 440 may be displaced to the second position.

Second annular seal 442 may define fifth and sixth radial surface areas ($A4_5$, $A4_6$) on first surface 443 and a seventh radial surface area ($A4_7$) on second surface 445. The sum of the fifth and sixth radial surface areas ($A4_5$, $A4_6$) may be equal to the seventh radial surface area ($A4_7$). Fifth radial surface area ($A4_5$) may be defined between second sealing diameter ($D4_2$) and a radially outer surface 478 of a sealing portion 480 of second annular seal 442. The sixth radial surface area ($A4_6$) may be defined between radially outer surface 478 and a radially inner surface 482 of sealing portion 480. A diametrical midpoint between radially inner and outer surfaces 478, 482 may be greater than or equal to the third sealing diameter ($D4_3$). The fifth radial surface area ($A4_5$) may be exposed to a suction pressure ($P_s$) and the sixth radial surface area ($A4_6$) may be exposed to a pressure that is generally the average of suction pressure ($P_s$) and discharge pressure ($P_d$) due to a pressure gradient across sixth radial surface area ($A4_6$). The seventh radial surface area ($A4_7$) may be defined between the second and third sealing diameters ($D4_2$, $D4_3$). The seventh radial surface area ($A4_7$) may be exposed to an intermediate fluid pressure ($P_i$) from intermediate fluid pocket 490.

The difference between radial surface areas exposed to intermediate, discharge, and suction pressure may provide for axial displacement of second annular seal 442 relative to end cap 424, non-orbiting scroll 470, and first annular seal 440. Based on the pressure differences within compressor 410, however, second annular seal 442 may be displaced axially from end cap 424, allowing communication between the sealed discharge path 401 and a suction pressure region.

As indicated below, $F4_{2,1}$ represents a force applied to first surface 443 of second annular seal 442 and $F4_{2,2}$ represents a force applied to second surface 445 of second annular seal 442.

$$F4_{2,1}=(A4_5)(P_s)+(A4_6)(P_d+P_s)/2$$

$$F4_{2,2}=(A4_7)(P_i)$$

When $F4_{2,1}>F4_{2,2}$, second annular seal 442 may be displaced axially outwardly from end cap 424. When $F4_{2,1}<F4_{2,2}$, second annular seal 442 may be sealingly engaged with end cap 424.

Figure 6:
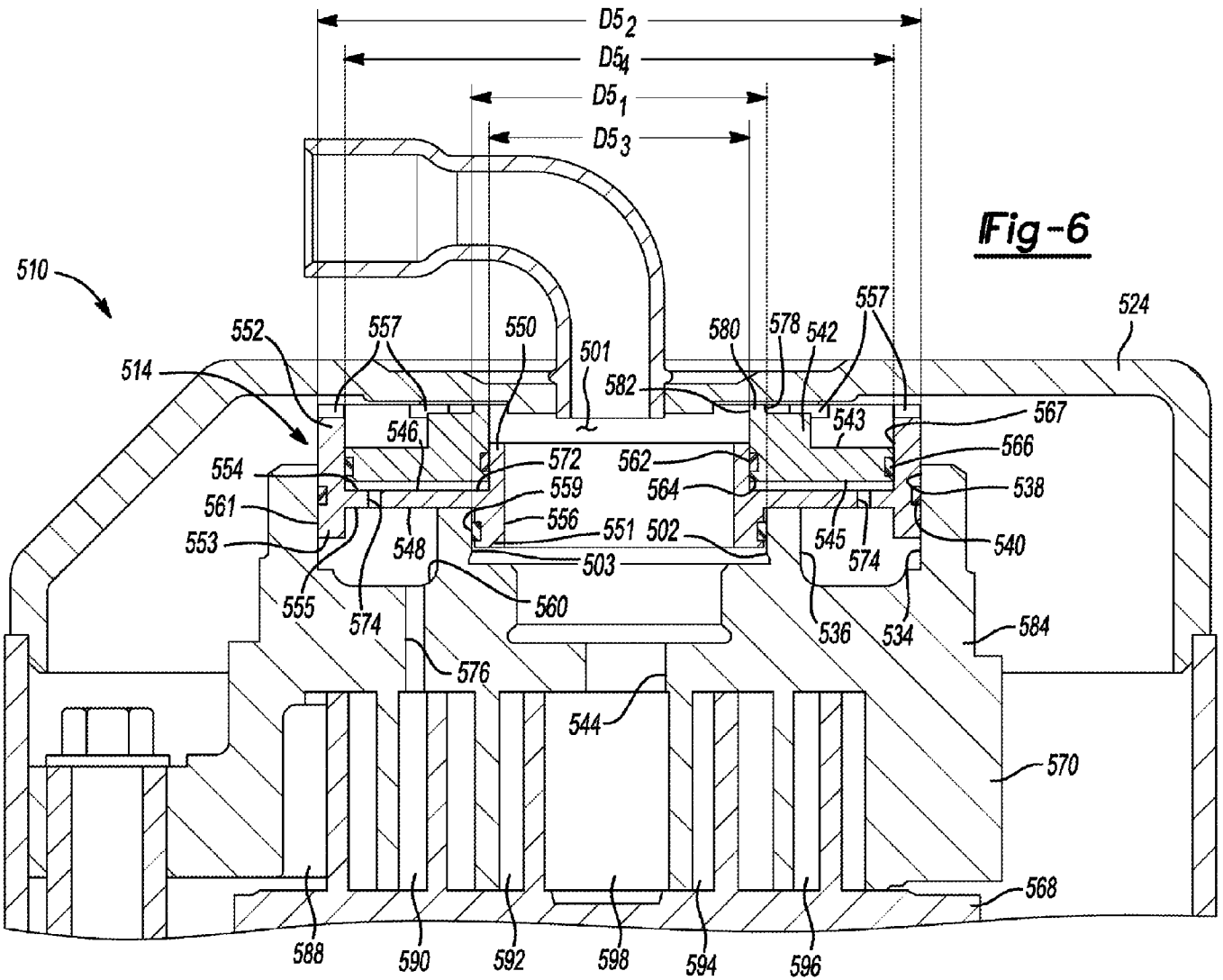
FIG. 6 is a fragmentary sectional view of another compressor according to the present disclosure.

Another compressor 510 is shown in FIG. 6. Compressor 510 may be similar to compressor 310 with the exception of the features discussed below regarding seal assembly 514 and channel 534 in end plate 584 of non-orbiting scroll 570 and corresponding sidewalls 536, 538. Seal assembly 514 may be disposed between non-orbiting scroll 570 and end cap 524.

Seal assembly 514 may include first and second annular seals 540, 542. First and second annular seals 540, 542 may be disposed axially between end cap 524 and non-orbiting scroll 570 and axially displaceable relative to end cap 524, non-orbiting scroll 570, and one another. First annular seal 540 may include first and second surfaces 546, 548 generally opposite one another. First surface 546 may include first and second axially extending protrusions 550, 552 forming a first channel 554 therebetween and second surface 548 may include third and fourth axially extending protrusions 551, 553 forming a second channel 555 therebetween. First axially extending protrusion 552 may limit axial movement of the first annular seal 540 and may include a plurality of notches 557 facing the end cap 524 to allow gas flow therethrough. A radially outer surface 559 of third axially extending protrusion 551 may be sealingly engaged with a radially inner surface 503 of a recess 502 in end plate 584 generally surrounding opening 544. A radially outer surface 561 of fourth axially extending protrusion 553 may be sealingly engaged with outer sidewall 538 of channel 534, forming a sealed annular chamber 560 between first annular seal 540 and end plate 584 of non-orbiting scroll 570.

Second annular seal 542 may include first and second surfaces 543, 545 generally opposite one another. Second annular seal 542 may be sealingly engaged with a lower surface of end cap 524 at a first end. More specifically, a portion of first surface 543 may be sealingly engaged with end cap 524. A second end of second annular seal 542 may be disposed within channel 554 in first annular seal 540. A radially inner surface 562 of second annular seal 542 may be sealingly engaged with a radially outer surface 564 of first axially extending protrusion 550 and a radially outer surface 566 of second annular seal 542 may be sealingly engaged with a radially inner surface 567 of first annular seal 540, forming a second sealed annular chamber 572.

First annular seal 540 may include apertures 574 extending through first and second surfaces 546, 548 and providing fluid communication between first and second sealed annular chambers 560, 572. End plate 584 of non-orbiting scroll 570 may include a passage 576 extending into intermediate fluid pocket 590 and providing fluid communication between intermediate fluid pocket 590 and first sealed annular chamber 560. While shown extending into intermediate fluid pocket 590, it is understood that passage 576 may extend into any of intermediate fluid pockets 590, 592, 594, 596. As a result of apertures 574 in first annular seal 540, intermediate fluid pocket 590 may also be in fluid communication with second sealed annular chamber 572. As such, first and second sealed annular chambers 560, 572 may contain fluid at the same pressure as one another.

Radially inner surface 503 of a recess 502 in end plate 584 may define a first sealing diameter ($D5_1$) and outer sidewall 538 of channel 534 may define a second sealing diameter ($D5_2$). Radially outer surface 564 of first axially extending protrusion 550 may define a third sealing diameter ($D5_3$) and radially inner surface 567 of second axially extending protrusion 552 may define a fourth sealing diameter ($D5_4$). The second sealing diameter may be greater than the fourth sealing diameter, the fourth sealing diameter may be greater than the first sealing diameter, and the first sealing diameter may be greater than the third sealing diameter ($D5_2>D5_4>D5_1>D5_3$).

First surface 546 of first annular seal 540 may define a first radial surface area ($A5_1$) between the third and fourth sealing diameters ($D5_3$, $D5_4$) that is less than a second radial surface area ($A5_2$) defined by second surface 548 of first annular seal 540 between the first and second sealing diameters ($D5_1$, $D5_2$). Alternatively, first radial surface area ($A5_1$) may be equal to or even greater than second radial surface area ($A5_2$). Each of the first and second radial surface areas ($A5_1$, $A5_2$) may be exposed to the intermediate fluid pressure ($P_i$) from intermediate fluid pocket 590.

In light of the relationship between the sealing diameters $D5_1$, $D5_2$, $D5_3$, $D5_4$, first annular seal 540 may further define third and fourth radial surface areas ($A5_3$, $A5_4$). The third radial surface area ($A5_3$) may be defined by first surface 546 of first annular seal 540 between a radially inner surface 556 of first annular seal 540 and the third sealing diameter ($D5_3$) and may be less than the fourth radial surface area ($A5_4$). The fourth radial surface area ($A5_4$) may be defined by second surface 548 of first annular seal 540 between radially inner surface 556 of first annular seal 540 and the first sealing diameter ($D5_1$). Each of the third and fourth radial surface areas ($A5_3$, $A5_4$) may be exposed to a discharge pressure ($P_d$) in the sealed discharge path 501. A fifth radial surface area ($A5_5$) may be defined by first surface 546 of first annular seal 540 between the second and fourth sealing diameters ($D5_2$, $D5_4$) and may be exposed to a suction pressure ($P_s$). The sum of the first, third, and fifth radial surface areas ($A5_1$, $A5_3$, $A5_5$) may be equal to the sum of the second and fourth radial surface areas ($A5_2$, $A5_4$).

The difference between radial surface areas on first and second surfaces 546, 548 exposed to intermediate, discharge, and suction pressures may provide for displacement of first annular seal 540 relative to end cap 524, non-orbiting scroll 570, and second annular seal 542 during compressor operation. More specifically, first annular seal 540 may be displaceable between a first position where first annular seal 540 contacts non-orbiting scroll 570 and exerts an axial force against non-orbiting scroll 570, urging non-orbiting scroll 570 toward orbiting scroll 568 and a second position where first annular seal 540 is displaced axially from non-orbiting scroll 570 and engages end cap 524. The axial force provided by first annular seal 540 may be generated by fluid pressure acting thereon. The engagement between first annular seal 540 and non-orbiting scroll 570 when first annular seal 540 is in the first position may generally provide a biasing force in addition to the force normally applied to non-orbiting scroll 570 by fluid pressure acting directly thereon. This additional biasing force is removed from non-orbiting scroll 570 when first annular seal 540 is in the second position.

As indicated below, $F5_{1,1}$ represents a force applied to first surface 546 of first annular seal 540 and $F5_{1,2}$ represents a force applied to second surface 548 of first annular seal 540.

$$F5_{1,1}=(A5_1)(P_i)+(A5_3)(P_d)+(A5_5)(P_s)$$

$$F5_{1,2}=(A5_2)(P_i)+(A5_4)(P_d)$$

When $F5_{1,1}>F5_{1,2}$, first annular seal 540 may be displaced to the first position. When $F5_{1,1}<F5_{1,2}$, first annular seal 540 may be displaced to the second position.

Second annular seal 542 may define sixth and seventh radial surface areas ($A5_6$, $A5_7$) on first surface 543 and an eighth radial surface area ($A5_8$) on second surface 545. The sixth radial surface area ($A5_6$) may be defined between fourth sealing diameter ($D5_4$) and a radially outer surface 578 of a sealing portion 580 of second annular seal 542. The seventh radial surface area ($A5_7$) may be defined between radially outer surface 578 of sealing portion 580 and a radially inner surface 582 thereof. The sixth radial surface area ($A5_6$) may be exposed to a suction pressure ($P_s$) and the seventh radial surface area ($A5_7$) may be exposed to a pressure that is generally the average of suction pressure ($P_s$) and discharge pressure ($P_d$) due to a pressure gradient across seventh radial surface area ($A5_7$). The eighth radial surface area ($A5_8$) may be defined between the third and fourth sealing diameters ($D5_3$, $D5_4$) and may be exposed to an intermediate fluid pressure ($P_i$) from intermediate fluid pocket 590. The sum of the sixth and seventh radial surface areas ($A5_6$, $A5_7$) may be equal to the eighth radial surface area ($A5_8$).

The difference between radial surface areas exposed to intermediate and suction pressures may provide for axial displacement of second annular seal 542 relative to end cap 524, non-orbiting scroll 570, and first annular seal 540. However, based on the pressure differences within compressor 510, second annular seal 542 may be displaced axially outwardly from end cap 524, allowing communication between the sealed discharge path 501 and a suction pressure region.

As indicated below, $F5_{2,1}$ represents a force applied to first surface 543 of second annular seal 542 and $F5_{2,2}$ represents a force applied to second surface 545 of second annular seal 542.

$$F5_{2,1}=(A5_6)(P_s)+(A5_7)(P_d+P_s)/2$$

$$F5_{2,2}=(A5_8)(P_i)$$

When $F5_{2,1}>F5_{2,2}$, second annular seal 542 may be displaced axially outwardly from end cap 524. When $F5_{2,1}<F5_{2,2}$, second annular seal 542 may be sealingly engaged with end cap 524.

Figure 7:
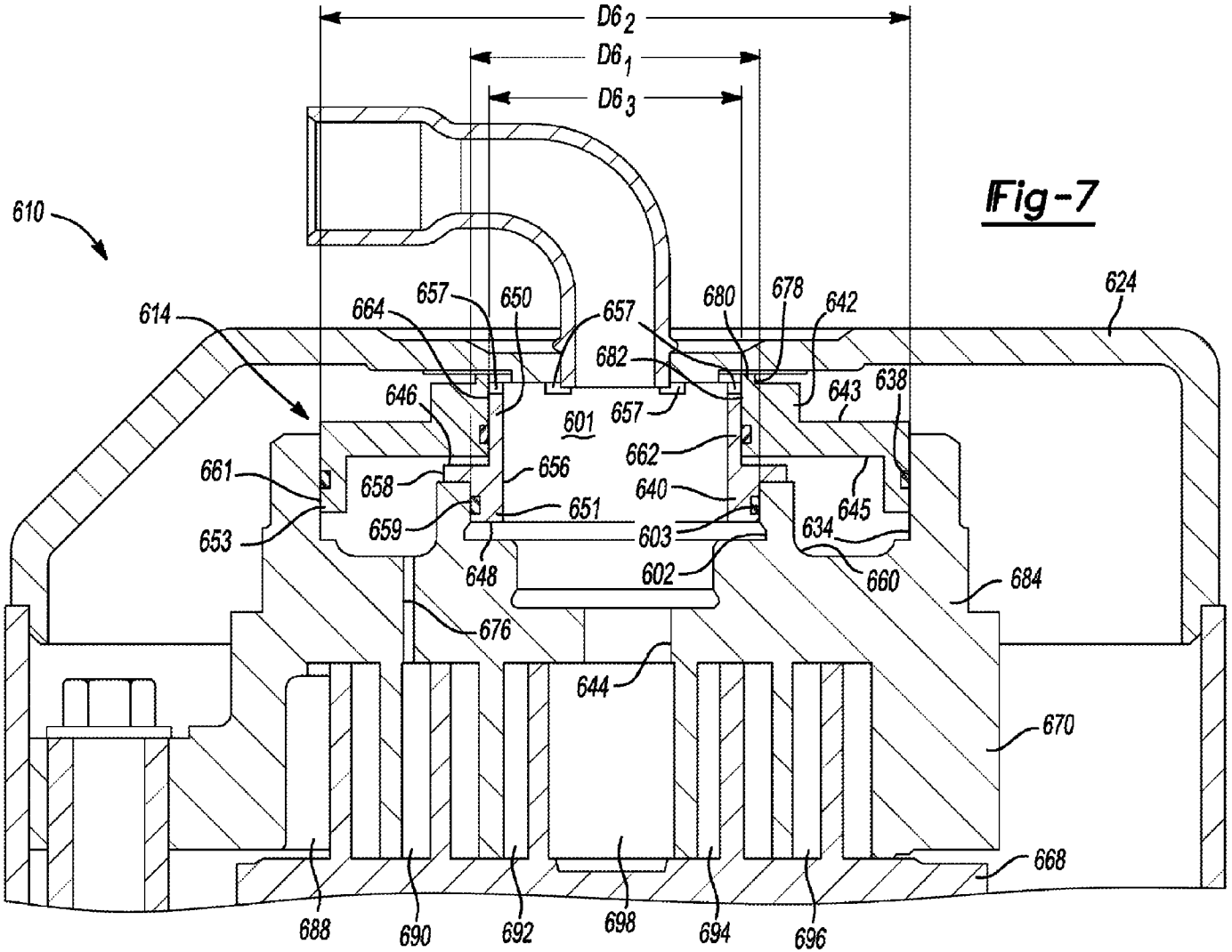
FIG. 7 is a fragmentary sectional view of another compressor according to the present disclosure.

With additional reference to FIG. 7, another seal assembly 614 is shown incorporated in compressor 610. Compressor 610 may be similar to compressor 510 with the exception of seal assembly 614. Seal assembly 614 may include first and second annular seals 640, 642.

First annular seal 640 may include first and second surfaces 646, 648 generally opposite one another. First surface 646 may include an axially extending protrusion 650 extending from a radially inner portion thereof and second surface 648 may include a second axially extending protrusion 651 extending from the radially inner portion thereof. Axially extending protrusion 650 may limit axial movement of the first annular seal 640 and may include a plurality of notches 657 facing the end cap 624 to allow gas flow therethrough. A radially outer surface 659 of second axially extending protrusion 651 may be sealingly engaged with a radially inner surface 603 of a recess 602 in end plate 684 generally surrounding opening 644.

Second annular seal 642 may include first and second surfaces 643, 645 generally opposite one another. Second annular seal 642 may be sealingly engaged with a lower surface of end cap 624 at a first end. More specifically, a portion of first surface 643 may sealingly engage end cap 624. Second surface 645 may include an axially extending protrusion 653 extending from a radially outer portion thereof. A radially outer surface 661 of axially extending protrusion 653 may be sealingly engaged with a outer sidewall 638 of channel 634 and a radially inner surface 662 of second annular seal 642 may be sealingly engaged with a radially outer surface 664 of first axially extending protrusion 650 of first annular seal 640, forming a sealed annular chamber 660 between first and second annular seal 640, 642 and channel 634.

End plate 684 of non-orbiting scroll 670 may include a passage 676 extending into intermediate fluid pocket 690 and providing fluid communication between intermediate fluid pocket 690 and sealed annular chamber 660. While shown extending into intermediate fluid pocket 690, it is understood that passage 676 may extend into any of intermediate fluid pockets 690, 692, 694, 696. Radially outer surface 659 of second axially extending protrusion 651 of first annular seal 640 may define a first sealing diameter ($D6_1$) and outer sidewall 638 of channel 634 may define a second sealing diameter ($D6_2$). Radially outer surface 664 of first axially extending protrusion 650 may define a third sealing diameter ($D6_3$). The second sealing diameter may be greater than the first sealing diameter and the first sealing diameter may be greater than the third sealing diameter ($D6_2>D6_1>D6_3$).

First surface 646 of first annular seal 640 may define a first radial surface area ($A6_1$) between the third sealing diameter ($D6_3$) and a radially outer surface 658 that is greater than a second radial surface area ($A6_2$) defined by second surface 648 of first annular seal 640 between the first sealing diameter ($D6_1$) and radially outer surface 658. Each of the first and second radial surface areas ($A6_1$, $A6_2$) may be exposed to an intermediate fluid pressure ($P_i$) from intermediate fluid pocket 690.

In light of the relationship between the sealing diameters $D6_1$, $D6_2$, $D6_3$, first surface 646 of first annular seal 640 may further define a third radial surface area ($A6_3$) between a radially inner surface 656 of first annular seal 640 and third sealing diameter ($D6_3$) that is less than a fourth radial surface area ($A6_4$) defined by second surface 648 of first annular seal 640 between radially inner surface 656 and first sealing diameter ($D6_1$). The third and fourth radial surface areas ($A6_3$, $A6_4$) may be exposed to a discharge pressure ($P_d$) in the sealed discharge path 601. The sum of the first and third radial surface areas ($A6_1$, $A6_3$) may be equal to the sum of the second and fourth radial surface areas ($A6_2$, $A6_4$).

The difference between the first and second radial surface areas ($A6_1$, $A6_2$) exposed to intermediate pressure and the third and fourth radial surface areas ($A6_3$, $A6_4$) exposed to discharge pressure may provide for displacement of first annular seal 640 relative to end cap 624, non-orbiting scroll 670, and second annular seal 642 during compressor operation. More specifically, first annular seal 640 may be displaceable between a first position where first annular seal 640 contacts non-orbiting scroll 670 and exerts an axial force against non-orbiting scroll 670, urging non-orbiting scroll 670 toward orbiting scroll 668 and a second position where first annular seal 640 is displaced axially from non-orbiting scroll 670 and engages end cap 624. The axial force provided by first annular seal 640 may be generated by fluid pressure acting thereon. The engagement between first annular seal 640 and non-orbiting scroll 670 when first annular seal 640 is in the first position may generally provide a biasing force in addition to the force normally applied to non-orbiting scroll 670 by fluid pressure acting directly thereon. This additional biasing force is removed from non-orbiting scroll 670 when first annular seal 640 is in the second position.

As indicated below, $F6_{1,1}$ represents a force applied to first surface 646 of first annular seal 640 and $F6_{1,2}$ represents a force applied to second surface 648 of first annular seal 640.

$$F6_{1,1}=(A6_1)(P_i)+(A6_3)(P_d)$$

$$F6_{1,2}=(A6_2)(P_i)+(A6_4)(P_d)$$

When $F6_{1,1}>F6_{1,2}$, first annular seal 640 may be displaced to the first position. When $F6_{1,1}<F6_{1,2}$, first annular seal 640 may be displaced to the second position.

Second annular seal 642 may define fifth and sixth radial surface areas ($A6_5$, $A6_6$) on first surface 643 and second surface 645 may define a seventh radial surface area ($A6_7$). The sum of the fifth and sixth radial surface areas ($A6_5$, $A6_6$) may be equal to the seventh radial surface area ($A6_7$). The fifth radial surface area ($A6_5$) may be defined between second sealing diameter ($D6_2$) and a radially outer surface 678 of a sealing portion 680 of second annular seal 642. The sixth radial surface area ($A6_6$) may be defined between radially outer surface 678 and a radially inner surface 682 of sealing portion 680. The fifth radial surface area ($A6_5$) may be exposed to suction pressure ($P_s$) and the sixth radial surface area ($A6_6$) may be exposed to a pressure that is generally the average of suction pressure ($P_s$) and discharge pressure ($P_d$) due to a pressure gradient across sixth radial surface area ($A6_6$). The seventh radial surface area ($A6_7$) may be defined between the second sealing diameter ($D6_2$) and the third sealing diameter ($D6_3$) and may be exposed to an intermediate fluid pressure from intermediate pocket 690.

The difference between radial surface areas exposed to intermediate, discharge, and suction pressures may provide for axial displacement of second annular seal 642 relative to end cap 624, non-orbiting scroll 670, and first annular seal 640. However, based on the pressure differences within compressor 610, second annular seal 642 may be displaced axially from end cap 624, allowing communication between the sealed discharge path 601 and a suction pressure region.

As indicated below, $F6_{2,1}$ represents a force applied to first surface 643 of second annular seal 642 and $F6_{2,2}$ represents a force applied to second surface 645 of second annular seal 642.

$$F6_{2,1}=(A6_5)(P_s)+(A6_6)(P_d+P_s)/2$$

$$F6_{2,2}=(A6_7)(P_i)$$

When $F6_{2,1}>F6_{2,2}$, second annular seal 642 may be displaced axially outwardly from end cap 624. When $F6_{2,1}<F6_{2,2}$, second annular seal 642 may abut end cap 624.

Figure 8:
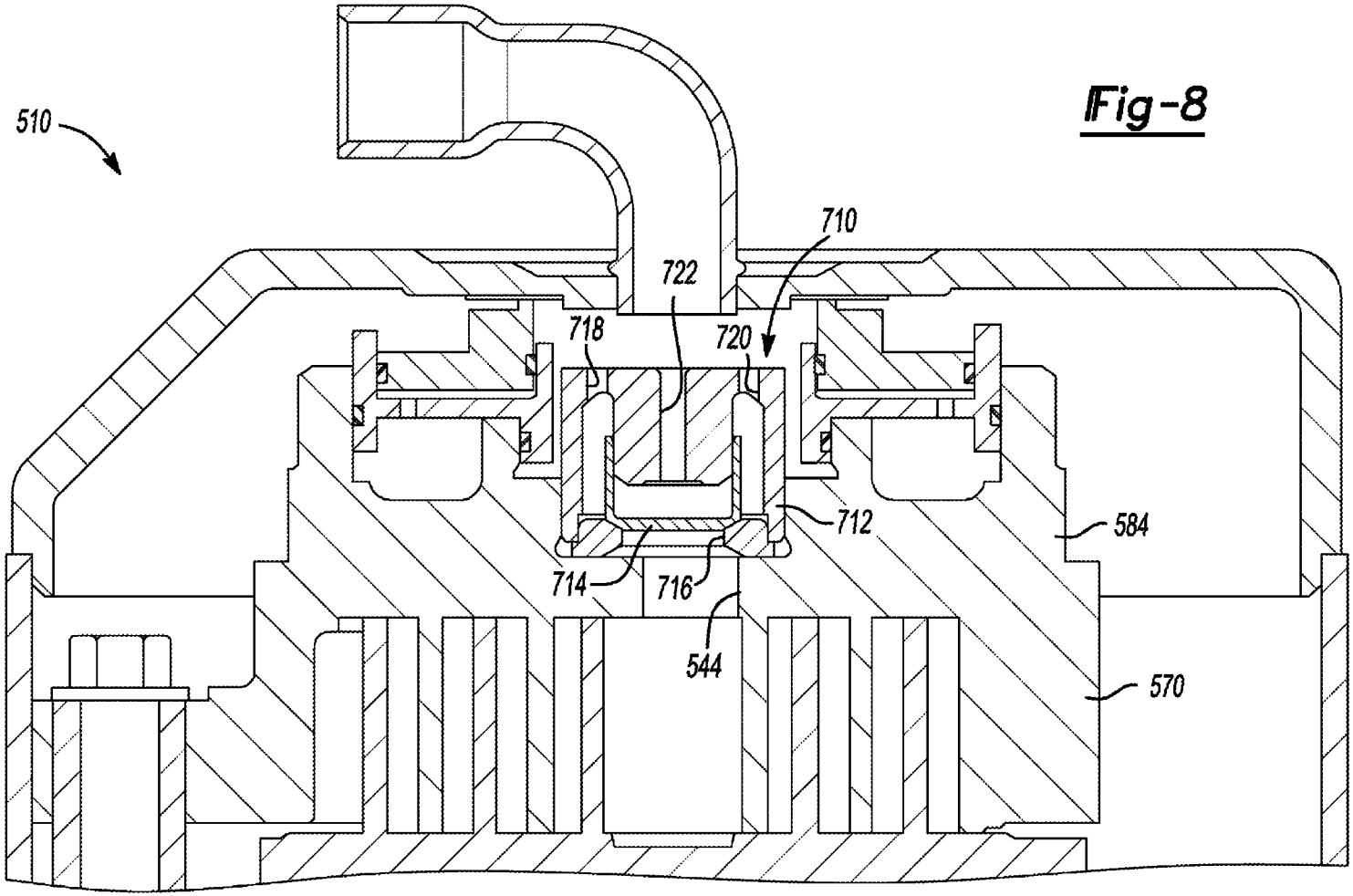
FIG. 8 is a fragmentary sectional view of another compressor according to the present disclosure.

With additional reference to FIG. 8, compressor 510 is shown having a shut-down valve assembly 710 fixed to end plate 584 of non-orbiting scroll 570 adjacent opening 544. Valve assembly 710 may include a valve body 712 and a valve plate 714. Valve body 712 may include discharge passages 716, 718, 720 and a reverse flow passage 722. Valve plate 714 may be displaceable between first and second positions. When in the first position, valve plate 714 may allow communication between flow passage 716 and flow passages 718, 720, thereby allowing fluid flow from opening 544 in end plate 584 of non-orbiting scroll 570 to exit compressor 510. When in the second position, valve plate 714 may seal opening 544 in end plate 584, preventing fluid flow from flowing through opening 544 at compressor shutdown.

While shown incorporated in compressor 510 and fixed to end plate 584 of non-orbiting scroll 570, it is understood that shut-down valve assembly 710 may be incorporated in any of the compressors described herein. Further, it is understood that shut-down valve assembly 710 may alternatively be fixed to first or second annular seals 540, 542 of seal assembly 514, or any of the seal assemblies disclosed herein.

Figure 9:
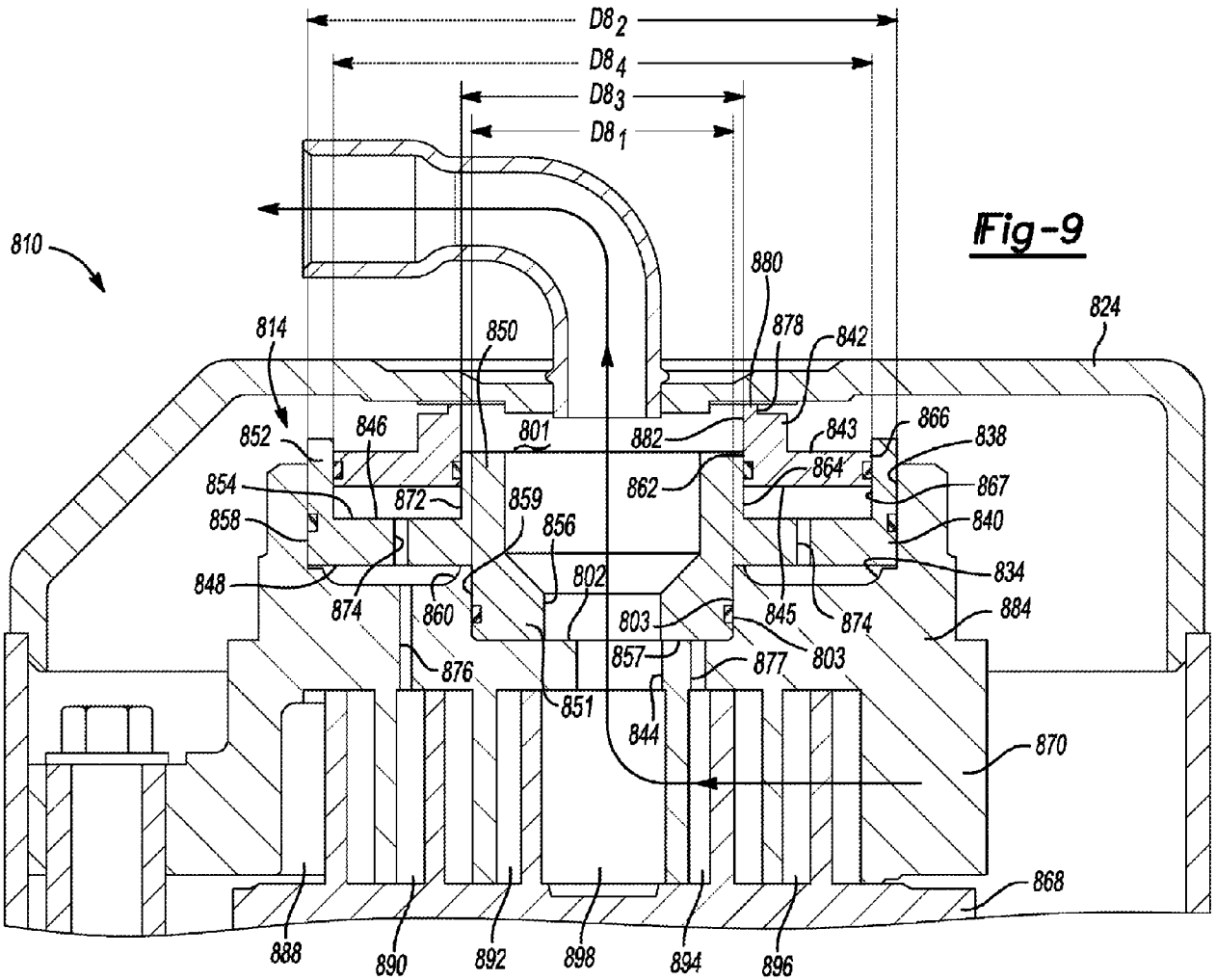
FIG. 9 is a fragmentary sectional view of another compressor according to the present disclosure.
Figure 10:
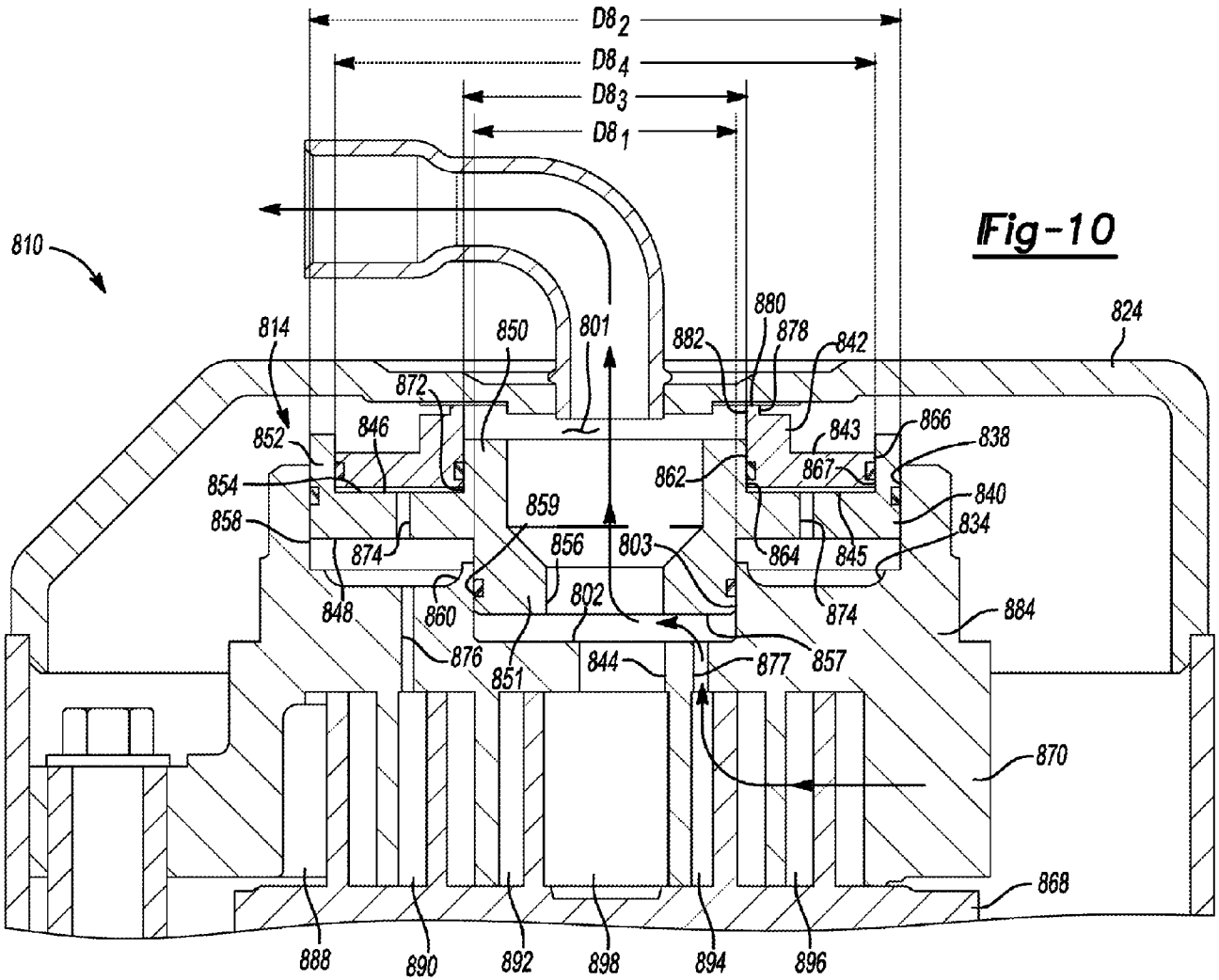
FIG. 10 is a additional fragmentary sectional view of the compressor of FIG. 9.
Figure 11:
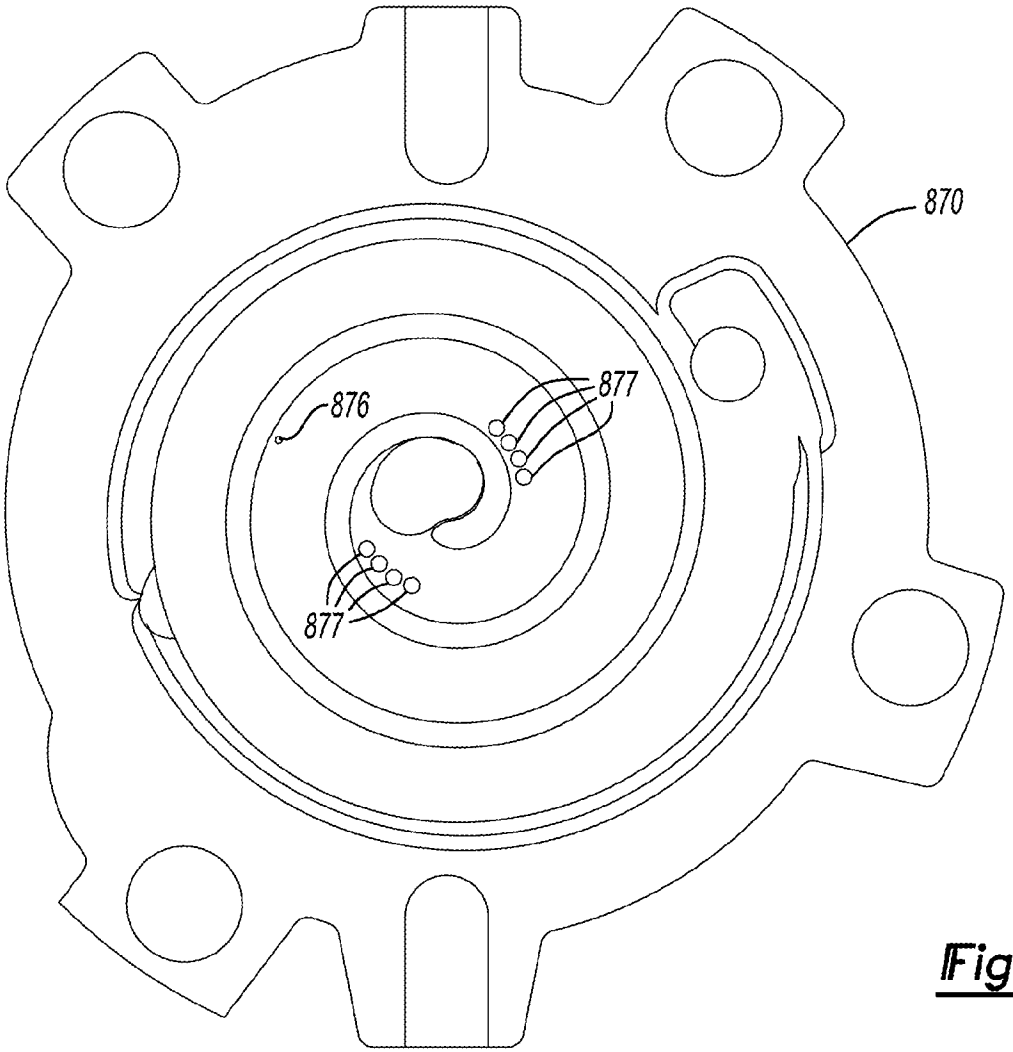
FIG. 11 is a plan view of a non-orbiting scroll of the compressor of FIG. 9.

Another compressor 810 is shown in FIGS. 9, 10, and 11. Compressor 810 may be similar to compressor 510 with the exception of the features discussed below regarding seal assembly 814 and end plate 884 of non-orbiting scroll 870. Seal assembly 814 may be disposed between non-orbiting scroll 870 and end cap 824.

Seal assembly 814 may include first and second annular seals 840, 842. First and second annular seals 840, 842 may be disposed axially between end cap 824 and non-orbiting scroll 870 and may be axially displaceable relative to end cap 824, non-orbiting scroll 870 and one another. First annular seal 840 may include first and second surfaces 846, 848 generally opposite one another. First surface 846 may include first and second axially extending protrusions 850, 852 forming a first channel 854 therebetween and second surface 848 may include a third axially extending protrusion 851. A radially outer surface 859 of third axially extending protrusion 851 may be sealingly engaged with a radially inner surface 803 of a recess 802 in end plate 884 generally surrounding opening 844. An axial end surface 857 of third axially extending protrusion 851 may sealingly engage end plate 884, as discussed below. A radially outer surface 858 of first annular seal 840 may sealingly engage outer sidewall 838 of channel 834, forming a sealed annular chamber 860 between first annular seal 840 and end plate 884.

Second annular seal 842 may include first and second surfaces 843 and 845 generally opposite one another. Second annular seal 842 may be sealingly engaged with a lower surface of end cap 824 at a first end. More specifically, a portion of first surface 843 may be sealingly engaged with end cap 824. A second end of second annular seal 842 may be disposed within channel 854 in first annular seal 840. A radially inner surface 862 of second annular seal 842 may be sealingly engaged with a radially outer surface 864 of first axially extending protrusion 850 and a radially outer surface 866 of second annular seal 842 may be sealingly engaged with a radially inner surface 867 of first annular seal 840, forming a second sealed annular chamber 872.

First annular seal 840 may include apertures 874 extending through first and second surfaces 846, 848 and providing fluid communication between first and second sealed annular chambers 860, 872. End plate 884 of non-orbiting scroll 870 may include a first passage 876 extending into intermediate fluid pocket 890 and providing fluid communication between intermediate fluid pocket 890 and first sealed annular chamber 860. While shown extending into intermediate fluid pocket 890, it is understood that intermediate fluid passage 876 may extend into any of intermediate fluid pockets 890, 892, 894, 896. As a result of apertures 874 in first annular seal 840, intermediate fluid pocket 890 may also be in fluid communication with second sealed annular chamber 872. As such, first and second sealed annular chambers 860, 872 may contain fluid at the same pressure as one another.

End plate 884 may include a second passage 877 extending into intermediate fluid pocket 894. Passage 877 may provide selective venting of intermediate fluid pocket 894 to the sealed discharge path 801 when axial end surface 857 of third axially extending protrusion 851 is not in sealing engagement with end plate 884. Intermediate fluid pocket 894 may be a radially innermost fluid pocket before discharge pocket 898. As seen in FIG. 11, multiple passages 877 may be provided for venting of intermediate fluid pocket 894. Each of passages 877 may be disposed radially inwardly relative to passage 876.

Radially inner surface 803 of a recess 802 in end plate 884 may define a first sealing diameter ($D8_1$) and outer sidewall 838 of channel 834 may define a second sealing diameter ($D8_2$). Radially outer surface 864 of first axially extending protrusion 850 may define a third sealing diameter ($D8_3$) and radially inner surface 867 of second axially extending protrusion 852 may define a fourth sealing diameter ($D8_4$). The second sealing diameter may be greater than the fourth sealing diameter, the fourth sealing diameter may be greater than the third sealing diameter, and the third sealing diameter may be greater than the first sealing diameter ($D8_2>D8_4>D8_3>D8_1$).

First surface 846 of first annular seal 840 may define a first radial surface area ($A8_1$) between the third and fourth sealing diameters ($D8_3$, $D8_4$) that is less than a second radial surface area ($A8_2$) defined by second surface 848 of first annular seal 840 between first and second sealing diameters ($D8_1$, $D8_2$). Each of the first and second radial surface areas ($A8_1$, $A8_2$) may be exposed to intermediate fluid pressure ($P_i$) from intermediate fluid pocket 890.

In light of the relationship between sealing diameters $D8_1$, $D8_2$, $D8_3$, $D8_4$, first surface 846 of first annular seal 840 may further define third and fourth radial surface areas ($A8_3$, $A8_4$). The third radial surface area ($A8_3$) may be defined by first surface 846 of first annular seal 840 between a radially inner surface 856 of first annular seal 840 and third sealing diameter ($D8_3$) and may be greater than a fourth radial surface area ($A8_4$) defined by second surface 848 of first annular seal 840 between radially inner surface 856 and first sealing diameter ($D8_1$). Each of the third and fourth radial surface areas ($A8_3$, $A8_4$) may be exposed to a discharge pressure ($P_d$) in the sealed discharge path 801. A fifth radial surface area ($A8_5$) may be defined by first surface 846 of first annular seal 840 between the second and fourth sealing diameters ($D8_2$, $D8_4$) and may be exposed to a suction pressure ($P_s$). The sum of the first, third, and fifth radial surface areas ($A8_1$, $A8_3$, $A8_5$) may be equal to the sum of the second and fourth radial surface areas ($A8_2$, $A8_4$).

The difference between radial surface areas on the first and second surfaces 846, 848 exposed to intermediate, discharge, and suction pressures may provide for displacement of first annular seal 840 relative to end cap 824, non-orbiting scroll 870, and second annular seal 842 during compressor operation. More specifically, first annular seal 840 may be displaceable between a first position (shown in FIG. 9) where first annular seal contacts non-orbiting scroll 870 and exerts an axial force against non-orbiting scroll 870, urging non-orbiting scroll 870 toward orbiting scroll 868 and a second position (shown in FIG. 10) where first annular seal 840 is displaced axially form non-orbiting scroll 870 and toward end cap 824. When in the first position, axial end surface 857 of third axially extending protrusion 851 may sealingly engage end plate 884, sealing passage 877 therein. When in the second position, axial end surface 857 of third axially extending protrusion 851 may be axially offset from end plate 884, allowing fluid communication between intermediate fluid pocket 894 and the sealed discharge path 801.

As indicated below, $F8_{1,1}$ represents a force applied to first surface 846 of first annular seal 840 and $F8_{1,2}$ represents a force applied to second surface 848 of first annular seal 840.

$$F8_{1,1}=(A8_1)(P_i)+(A8_3)(P_d)+(A8_5)(P_s)$$

$$F8_{1,2}=(A8_2)(P_i)+(A8_4)(P_d)$$

When $F8_{1,1}>F8_{1,2}$, first annular seal 840 may be displaced to the first position to seal passage 877. When $F8_{1,1}<F8_{1,2}$, first annular seal 840 may be displaced to the second position to open passage 877.

Second annular seal 842 may define sixth and seventh radial surface areas ($A8_6$, $A8_7$) on first surface 843 and eighth radial surface area ($A8_8$) on second surface 845. The sixth radial surface area ($A8_6$) may be defined between the fourth sealing diameter ($D8_4$) and a radially outer surface 878 of a sealing portion 880 of second annular seal 842. The seventh radial surface area ($A8_7$) may be defined between radially outer surface 878 of sealing portion 880 and a radially inner surface 882 thereof. The sixth radial surface area ($A8_6$) may be exposed to suction pressure ($P_s$) and the seventh radial surface area ($A8_7$) may be exposed to a pressure that is generally the average of suction pressure ($P_s$) and discharge pressure ($P_d$) due to a pressure gradient across seventh radial surface area ($A8_7$). The eighth radial surface area ($A8_8$) may be defined between the third and fourth sealing diameters ($D8_3$, $D8_4$) and may be exposed to an intermediate fluid pressure ($P_i$) from intermediate fluid pocket 890. The sum of the sixth and seventh radial surface areas ($A8_6$, $A8_7$) may be equal to the eighth radial surface area ($A8_8$).

The difference between radial surface areas exposed to intermediate, discharge, and suction pressures may provide for axial displacement of second annular seal 842 relative to end cap 824, non-orbiting scroll 870, and first annular seal 840. However, based on the pressure differences within compressor 810, second annular seal 842 may be displaced axially outwardly from end cap 824, allowing communication between the sealed discharge path 801 and a suction pressure region.

As indicated below, $F8_{2,1}$ represents a force applied to first surface 843 of second annular seal 842 and $F8_{2,2}$ represents a force applied to second surface 845 of second annular seal 842.

$$F8_{2,1}=(A8_6)(P_s)+(A8_7)(P_d+P_s)/2$$

$$F8_{2,2}=(A8_8)(P_i)$$

When $F8_{2,1}>F8_{2,2}$, second annular seal 842 may be displaced axially outwardly from end cap 824. When $F8_{2,1}<F8_{2,2}$, second annular seal 842 may be sealingly engaged with end cap 824.

Figure 12:
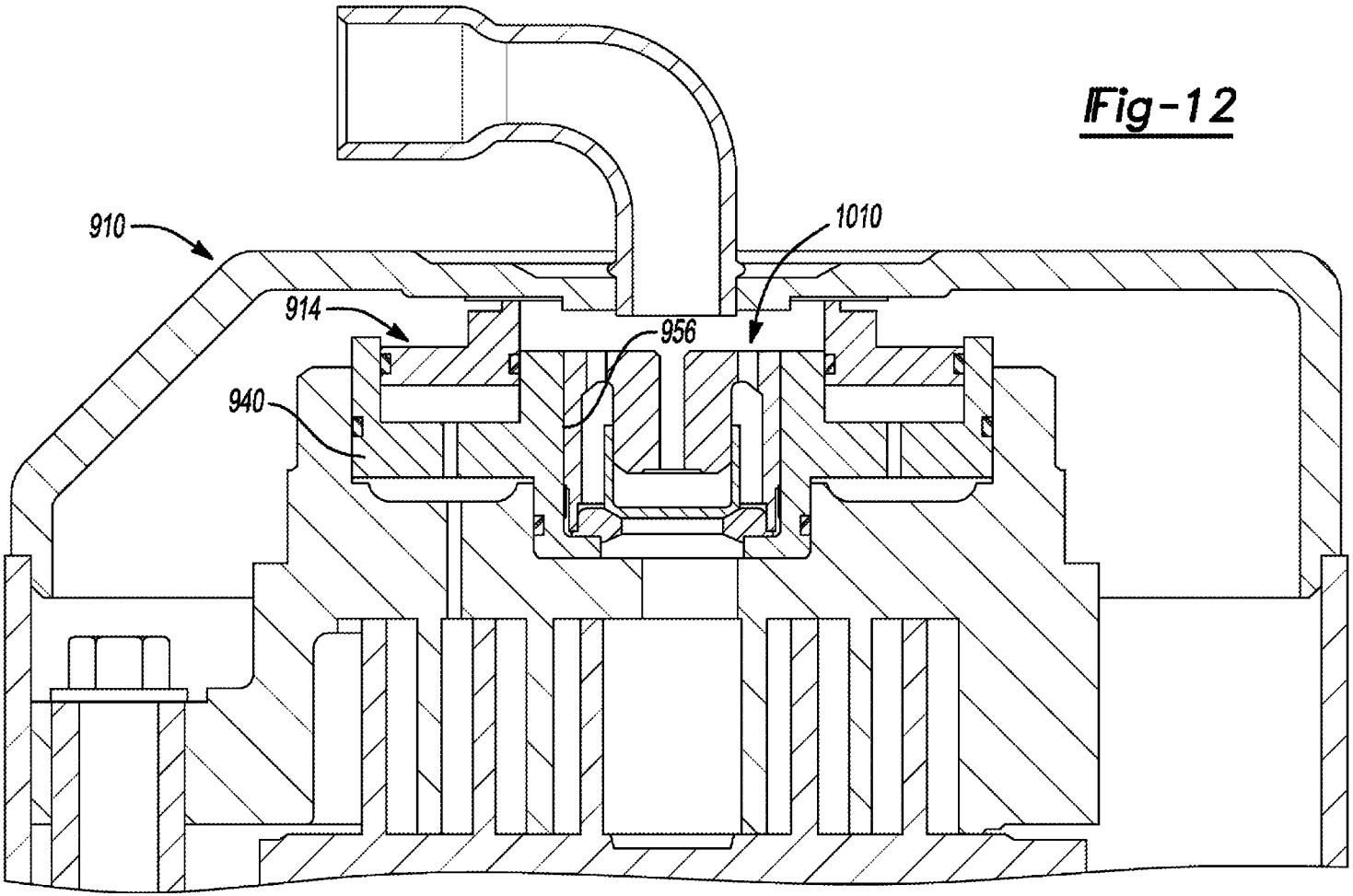
FIG. 12 is a fragmentary sectional view of another compressor according to the present disclosure.

Another compressor 910 is shown in FIG. 12. Compressor 910 includes a shut-down valve assembly 1010 coupled to seal assembly 914 as discussed above. Compressor 910 may be similar to compressor 810, except that seal assembly 914 has been modified to house valve assembly 1010 therein and first annular seal 940 has valve assembly 1010 fixed to a radially inner surface 956 thereof. Valve assembly 1010 may be similar to valve assembly 710 and therefore will not be described in detail.

Figure 13:
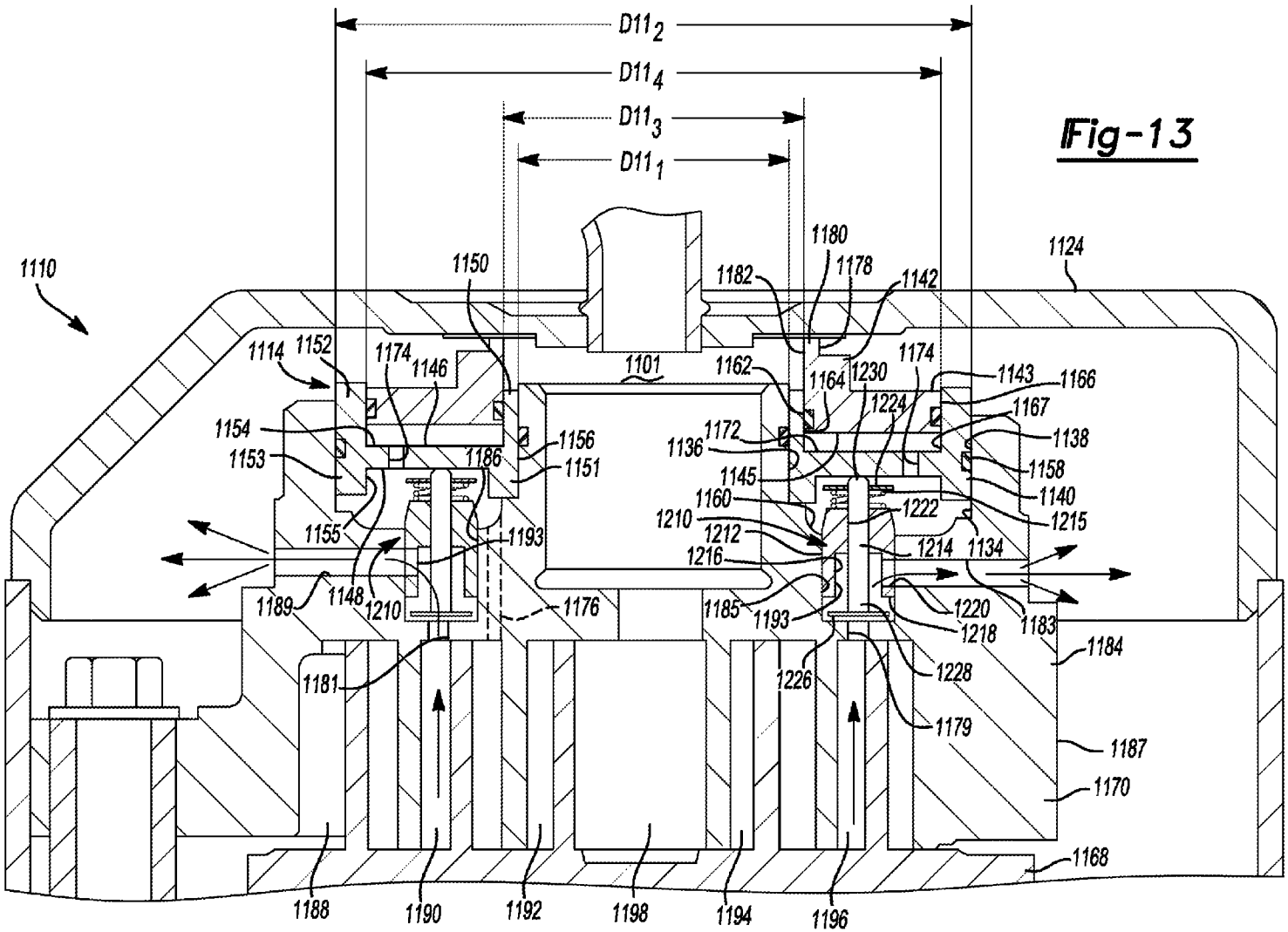
FIG. 13 is a fragmentary sectional view of another compressor according to the present disclosure the compressor in a first operating state.
Figure 14:
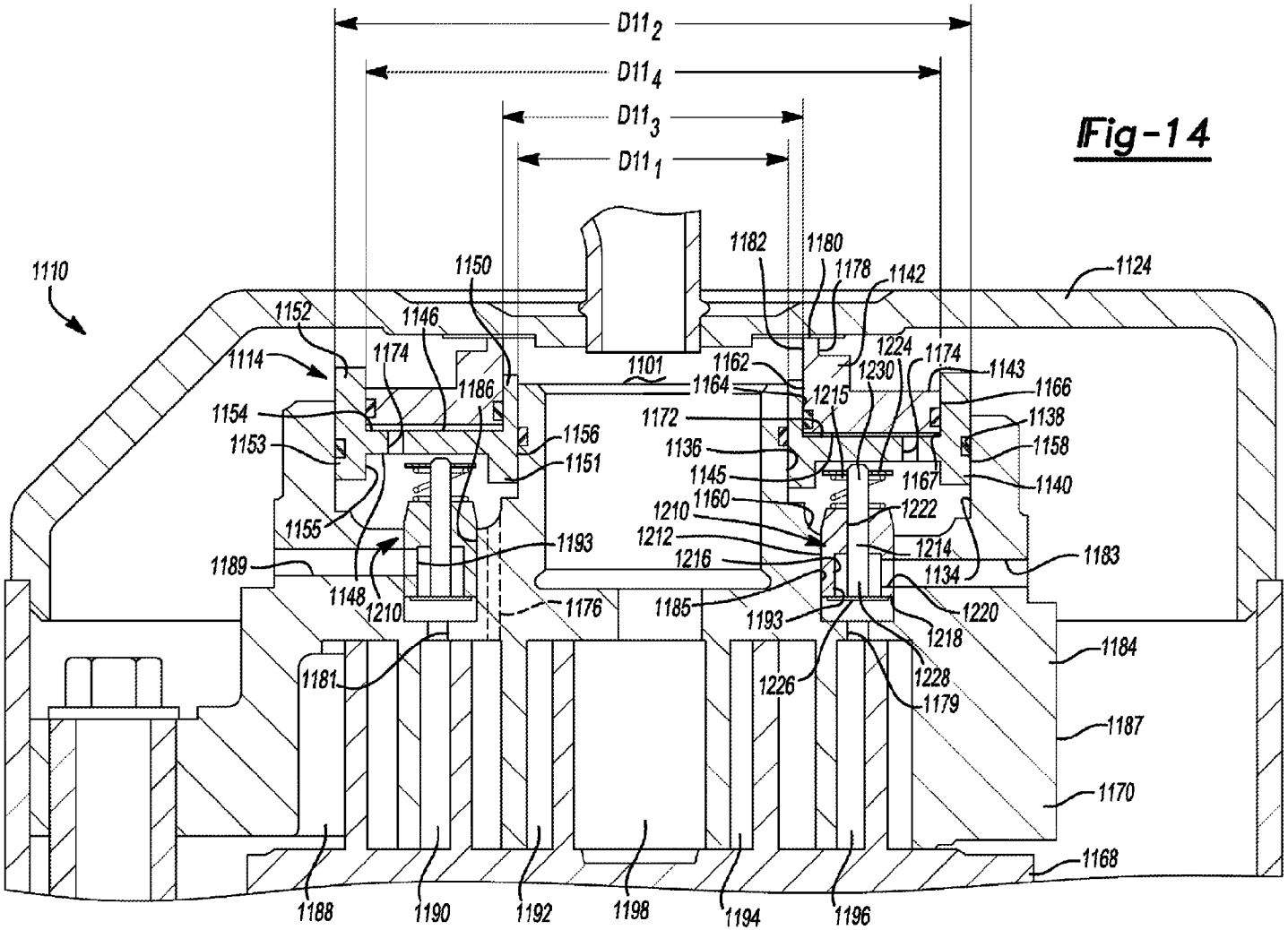
FIG. 14 is a fragmentary sectional view of the compressor of FIG. 13 in a second operating state.

Another compressor 1110 is shown in FIGS. 13 and 14. Compressor 1110 may be similar to compressor 310 with the exception of the features discussed below regarding seal assembly 1114, end plate 1184 of non-orbiting scroll 1170, and the valve assemblies 1210 disposed therein. Seal assembly 1114 may be disposed between non-orbiting scroll 1170 and end cap 1124.

Seal assembly 1114 may include first and second annular seals 1140, 1142. First and second annular seals 1140, 1142 may be disposed axially between end cap 1124 and non-orbiting scroll 1170 and may be axially displaceable relative to end cap 1124, non-orbiting scroll 1170, and one another. First annular seal 1140 may include first and second surfaces 1146, 1148 generally opposite one another. First surface 1146 may include first and second axially extending protrusions 1150, 1152 forming a first channel 1154 therebetween and second surface 1148 may include third and fourth axially extending protrusions 1151, 1153 forming a second channel 1155 therebetween. A radially inner surface 1156 of first annular seal 1140 may be sealingly engaged with inner sidewall 1136 of channel 1134 and a radially outer surface 1158 of first annular seal 1140 may be sealingly engaged with outer sidewall 1138 of channel 1134, forming a first sealed annular chamber 1160 between first annular seal 1140 and channel 1134.

Second annular seal 1142 may include first and second surfaces 1143, 1145 generally opposite one another. Second annular seal 1142 may be sealingly engaged with a lower surface of end cap 1124 at a first end. More specifically, a portion of first surface 1143 may be sealingly engaged with end cap 1124. A second end of second annular seal 1142 may be disposed within channel 1154 of first annular seal 1140. A radially inner surface 1162 of second annular seal 1142 may be sealingly engaged with a radially outer surface 1164 of first axially extending protrusion 1150 and a radially outer surface 1166 of second annular seal 1142 may be sealingly engaged with a radially inner surface 1167 of first annular seal 1140, forming a second sealed annular chamber 1172.

First annular seal 1140 may include apertures 1174 extending through first and second surfaces 1146, 1148 and providing fluid communication between first and second sealed annular chambers 1160, 1172. End plate 1184 of non-orbiting scroll 1170 may include a passage 1176 extending into one of intermediate fluid pockets 1190, 1192, 1194, 1196 and providing fluid communication between an intermediate fluid pocket 1190, 1192, 1194, 1196 and first sealed annular chamber 1160. Second sealed annular chamber 1172 may also be in communication with intermediate pressure from first sealed annular chamber 1160. As such, first and second sealed annular chambers 1160, 1172 may contain fluid at the same pressure as one another.

First and second recesses 1185, 1186 may extend into channel 1160 and house valve assemblies 1210 therein. A first passage 1179 may extend between one of intermediate fluid pockets 1190, 1192, 1194, 1196 and first recess 1185 and a second passage 1181 may extend between another of intermediate fluid pockets 1190, 1192, 1194, 1196 and second recess 1186 providing fluid communication therebetween. The intermediate fluid pocket that is in communication with first passage 1179 may be operating at a pressure that is generally equal to the pressure of the intermediate pocket that is in communication with second passage 1181. Alternatively, the intermediate fluid pockets that are in communication with the first and second passages 1179, 1181 may be operating at different pressures. Passage 1176 may extend into a different one of intermediate fluid pockets 1190, 1192, 1194, 1196 than first and second passages 1179, 1181. More specifically, first passage 1179 may be in communication with intermediate fluid pocket 1196 and second passage 1181 may be in communication with intermediate fluid pocket 1190. Passage 1176 may be in communication with an intermediate fluid pocket that is located radially inwardly relative to intermediate fluid pockets 1190, 1196. A third passage 1183 may extend radially between first recess 1185 and an outer surface 1187 of non-orbiting scroll 1170 and a fourth passage 1189 may extend between second recess 1186 and outer surface 1187 of non-orbiting scroll 1170, providing fluid communication between first and second recesses 1185, 1186 and a suction pressure region of compressor 1110.

As indicated above, a valve assembly 1210 may be located within each of recesses 1185, 1186. The orientation and engagement of valve assemblies 1210 within recesses 1185, 1186 may be similar to one another. Therefore, only the orientation and engagement of valve assembly 1210 within recess 1185 will be discussed in detail with the understanding that the description applies equally to the orientation and engagement of valve assembly 1210 within recess 1186. Further, it is understood that while compressor 1110 is shown including two valve assemblies 1210, a single valve assembly 1210 may be used with a single recess 1185 or a greater number of valve assemblies 1210 may be used with additional recesses and passages.

Valve assembly 1210 may include a valve housing 1212, a valve member 1214 and a biasing member 1215. Valve housing 1212 may be fixed to end plate 1184 of non-orbiting scroll 1170 within recess 1185. Valve housing 1212 may include a first passage 1216 extending through a lower surface 1218 thereof and a second passage 1220 extending radially through an outer portion thereof and in fluid communication with third passage 1183 in non-orbiting scroll 1170. First and second passages 1216, 1220 may be in fluid communication with one another and may be selectively in fluid communication with first passage 1179 in non-orbiting scroll 1170 through valve member 1214. A bore 1222 may extend between first passage 1216 and an upper surface of valve housing 1212, slidably supporting valve member 1214 therein.

Valve member 1214 may include a valve plate 1226 having a shaft 1228 extending therefrom and a plate 1224 fixed to an end of the shaft that extends through the upper surface of housing 1212 generally opposite valve plate 1226. Valve plate 1226 may have a diameter that is less than the outer diameter of valve housing 1212 and greater than the diameter of first passage 1216. Valve plate 1226 may be disposed between lower surface 1218 of valve housing 1212 and first passage 1179 in non-orbiting scroll 1170. As such, valve plate 1226 may allow fluid communication between first passage 1216 and therefore second passage 1220 of valve housing 1214 when in a first position (shown in FIG. 13) wherein valve plate 1226 is axially displaced from lower surface 1218 of valve housing 1214. Valve plate 1226 may seal first passage 1216 in valve housing 1212 from fluid communication with first passage 1179 in non-orbiting scroll 1170 when in a second position (shown in FIG. 14) wherein valve plate 1226 abuts lower surface 1218 of valve housing 1212.

Biasing member 1215 may be disposed between valve housing 1212 and valve member 1214. Biasing member 1215 may include a compression spring. Biasing member 1215 may provide a force ($F_B$) on second surface 1148 of first annular seal 1140 that urges first annular seal 1140 axially toward second annular seal 1142 when valve assembly 1210 is in an open position (seen in FIG. 13). Biasing member 1215 may apply an additional force to non-orbiting scroll 1170 that urges non-orbiting scroll 1170 toward orbiting scroll 1168 when valve assembly 1210 is in the open position.

As indicated above, shaft 1228 may extend from valve plate 1226. Shaft 1228 may extend through first passage 1216 and bore 1222 in valve housing 1214 and extend into sealed annular chamber 1160 where an end 1230 of shaft 1228 opposite valve plate 1226 may abut a lower surface of first annular seal 1140 when valve assembly 1210 is in the open position.

Inner sidewall 1136 of channel 1134 in non-orbiting scroll 1170 may define a first sealing diameter ($D11_1$) and outer sidewall 1138 of channel 1134 may define a second sealing diameter ($D11_2$). Radially outer surface 1164 of first axially extending protrusion 1150 may define a third sealing diameter ($D11_3$) and radially inner surface 1167 of second axially extending protrusion 1152 may define a fourth sealing diameter ($D11_4$). The second sealing diameter may be greater than the fourth sealing diameter, the fourth sealing diameter may be greater than the third sealing diameter, and the third sealing diameter may be greater than the first sealing diameter ($D11_2 > D11_4 > D11_3 > D11_1$).

First surface 1146 of first annular seal 1140 may define a first radial surface area ($A11_1$) between the third and fourth sealing diameters ($D11_3$, $D11_4$) that is less than a second radial surface area ($A11_2$) defined by second surface 1148 of first annular seal 1140 between the first and second sealing diameters ($D11_1$, $D11_2$). Each of the first and second radial surface areas ($A11_1$, $A11_2$) may be exposed to an intermediate fluid pressure ($P_i$) from passage 1176.

In light of the relationship between sealing diameters $D11_1$, $D11_2$, $D11_3$, $D11_4$, first surface 1146 of first annular seal 1140 may further define third and fourth radial surface areas ($A11_3$, $A11_4$). The third radial surface area ($A11_3$) may be defined by first surface 1146 of first annular seal 1140 between first and third sealing diameters ($D11_1$, $D11_3$) and may be exposed to a discharge pressure ($P_d$) within the sealed discharge path 1101. The fourth radial surface area ($A11_4$) may be defined between the second and fourth sealing diameters ($D11_2$, $D11_4$) and may be exposed to a suction pressure ($P_s$). The sum of the first, third, and fourth radial surface areas ($A11_1$, $A11_3$, $A11_4$) may be generally equal to the second radial surface area ($A11_2$) less the area of shafts 1228 of valve assembly 1210 contacting second surface 1148. A radial surface area ($A11_5$) on the back of valve plate 1226 in recess 1185 may be exposed to suction pressure ($P_s$) and a radial surface area ($A11_6$) on the front side of valve plate 1226 may be exposed to an intermediate pressure from first passage 1179 and a radial surface area ($A11_7$) on the back of valve plate 1226 in recess 1186 may be exposed to suction pressure ($P_s$) and a radial surface area ($A11_8$) on the front side of valve plate 1226 may be exposed to an intermediate pressure from second passage 1181.

The difference between radial surface areas on the first and second surfaces 1146, 1148 exposed to intermediate, discharge, and suction pressures, as well as the suction and intermediate pressures applied to valve plates 1226 and force ($F_B$) provided by biasing member 1215 may provide for displacement of first annular seal 1140, and therefore valve member 1214, relative to end cap 1124, non-orbiting scroll 1170, and second annular seal 1142 during compressor operation. More specifically, first annular seal 1140 and valve member 1214 may be displaceable between a first position (shown in FIG. 13) where first annular seal 1140 contacts non-orbiting scroll 1170 and exerts an axial force against non-orbiting scroll 1170, urging non-orbiting scroll 1170 toward orbiting scroll 1168 and opening valve assemblies 1210 and a second position (shown in FIG. 14) where first annular seal 1140 is axially displaced from non-orbiting scroll 1170 and toward end cap 1124 and closes valve assemblies 1210. As indicated above, valve member 1214 may be displaced between first and second positions with first seal member 1140.

As indicated below, $F11_{1,1}$ represents a force applied to first surface 1146 of first annular seal 1140 and $F11_{1,2}$ represents a force applied to second surface 1148 of first annular seal 1140.

$$F11_{1,1}=(A11_1)(P_i)+(A11_3)(P_d)+(A11_4+A11_5+A11_7)(P_s)$$

$$F11_{1,2}=(A11_2+A11_6+A11_8)(P_i)+F_B$$

When $F11_{1,1}>F11_{1,2}$, first annular seal 1140 may be displaced to the first position to open valve assemblies 1210. When $F11_{1,1}<F11_{1,2}$, first annular seal 1140 may be displaced to the second position to close valve assemblies 1210.

More specifically, when first annular seal 1140 is in the first position (shown in FIG. 13), valve member 1214 may be axially displaced by first annular seal 1140 to an open position where first and second passages 1179, 1181 are vented to a suction pressure region. When first annular seal is in the second position (shown in FIG. 14), valve plate 1226 of valve member 1214 may sealingly engage lower surface 1218 of valve housing 1212, sealing first and second passages 1179, 1181 from communication with the suction pressure region. As such, the combination of seal assembly 1114 and valve assemblies 1210 may provide a capacity modulation system for compressor 1110. As discussed above, actuation of the capacity modulation system provided by valve assemblies 1210 may occur through pressure differentials acting on first annular seal 1140 and valve assemblies 1210. Compressor 1110 may operate at a first capacity when first annular seal 1140 is in the second position (shown in FIG. 14) and may operate at a second capacity that is less than the first capacity when first annular seal 1140 is in the first position (shown in FIG. 13).

While described as including separate valve assemblies 1210, it is understood that a modified arrangement may include use of first annular seal 1140 itself be used to open and close first and second passages 1179, 1181.

Second annular seal 1142 may define ninth and tenth radial surface areas ($A11_9$, $A11_{10}$) on first surface 1143 and an eleventh radial surface area ($A11_{11}$) on second surface 1145. The ninth radial surface area ($A11_9$) may be defined between the fourth sealing diameter ($D11_4$) and a radially outer surface 1178 of a sealing portion 1180 of second annular seal 1142. The tenth radial surface area ($A11_{10}$) may be defined between radially outer surface 1178 of sealing portion 1180 and a radially inner surface 1182 thereof. The ninth radial surface area ($A11_9$) may be exposed to a suction pressure ($P_s$) and the tenth radial surface area ($A11_{10}$) may be exposed to a pressure that is generally the average of suction pressure ($P_s$) and discharge pressure ($P_d$) due to a pressure gradient across tenth radial surface area ($A11_{10}$). The eleventh radial surface area ($A11_{11}$) may be defined between the third and fourth sealing diameters ($D11_3$, $D11_4$) and may be exposed to an intermediate fluid pressure ($P_i$) from passage 1176. The sum of the ninth and tenth radial surface areas ($A11_9$, $A11_{10}$) may be equal to the eleventh radial surface area ($A11_{11}$).

The difference between radial surface areas exposed to intermediate, discharge, and suction pressures may provide for axial displacement of second annular seal 1142 relative to end cap 1124, non-orbiting scroll 1170, and first annular seal 1140. However, based on the pressure differences within compressor 1110, second annular seal 1142 may be displaced axially outwardly from end cap 1124, allowing communication between the sealed discharge path 1101 and a suction pressure region.

As indicated below, $F11_{2,1}$ represents a force applied to first surface 1143 of second annular seal 1142 and $F11_{2,2}$ represents a force applied to second surface 1145 of second annular seal 1142.

$$F11_{2,1}=(A11_9)(P_s)+(A11_{10})(P_d+P_s)/2$$

$$F11_{2,2}=(A11_{11})(P_i)$$

When $F11_{2,1}>F11_{2,2}$, second annular seal 1142 may be displaced axially outwardly from end cap 1124. When $F11_{2,1}<F11_{2,2}$, second annular seal 1142 may be sealingly engaged with end cap 1124.

Figure 15:
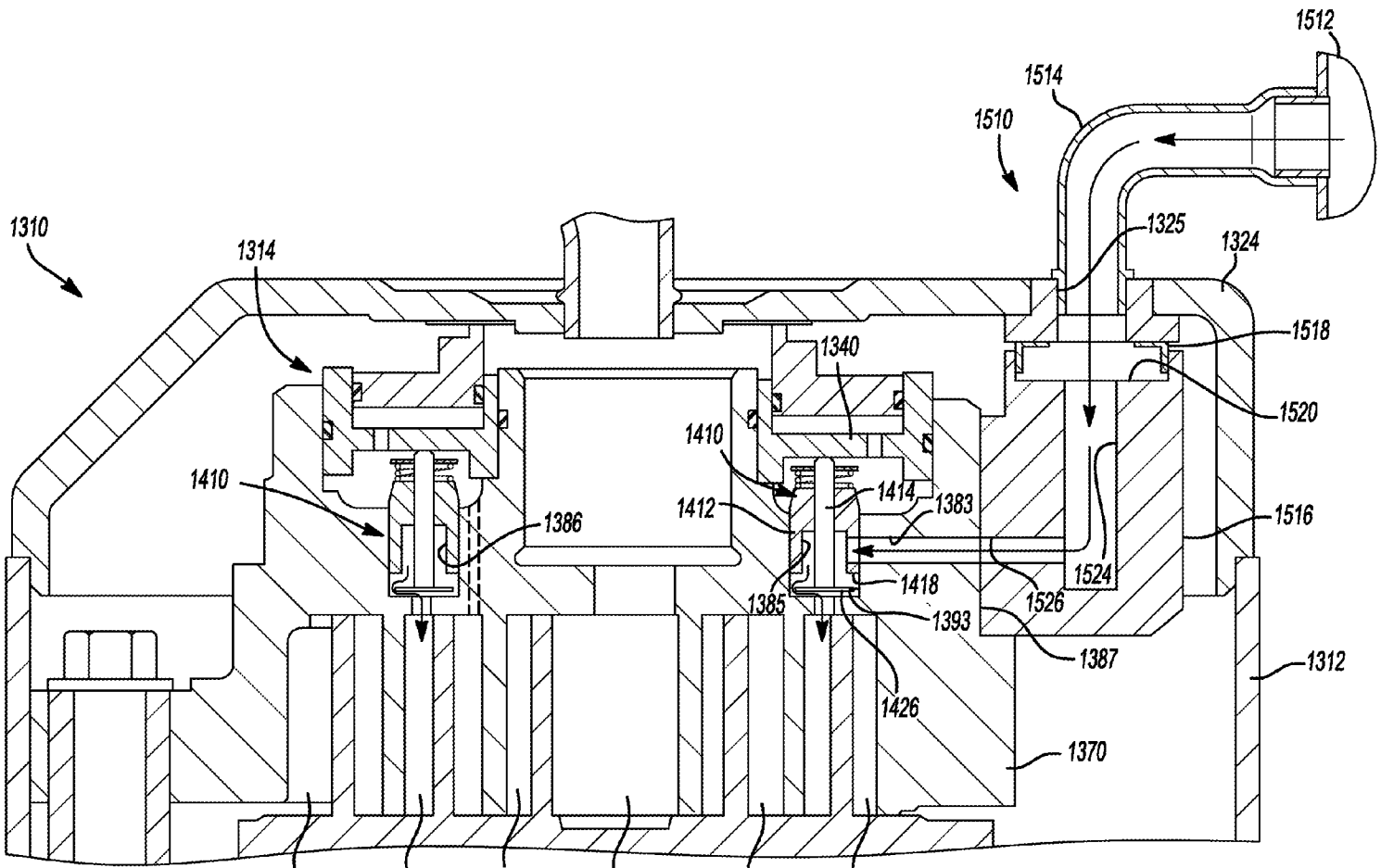
FIG. 15 is a fragmentary sectional view of another compressor according to the present disclosure the compressor in a first operating state.
Figure 16:
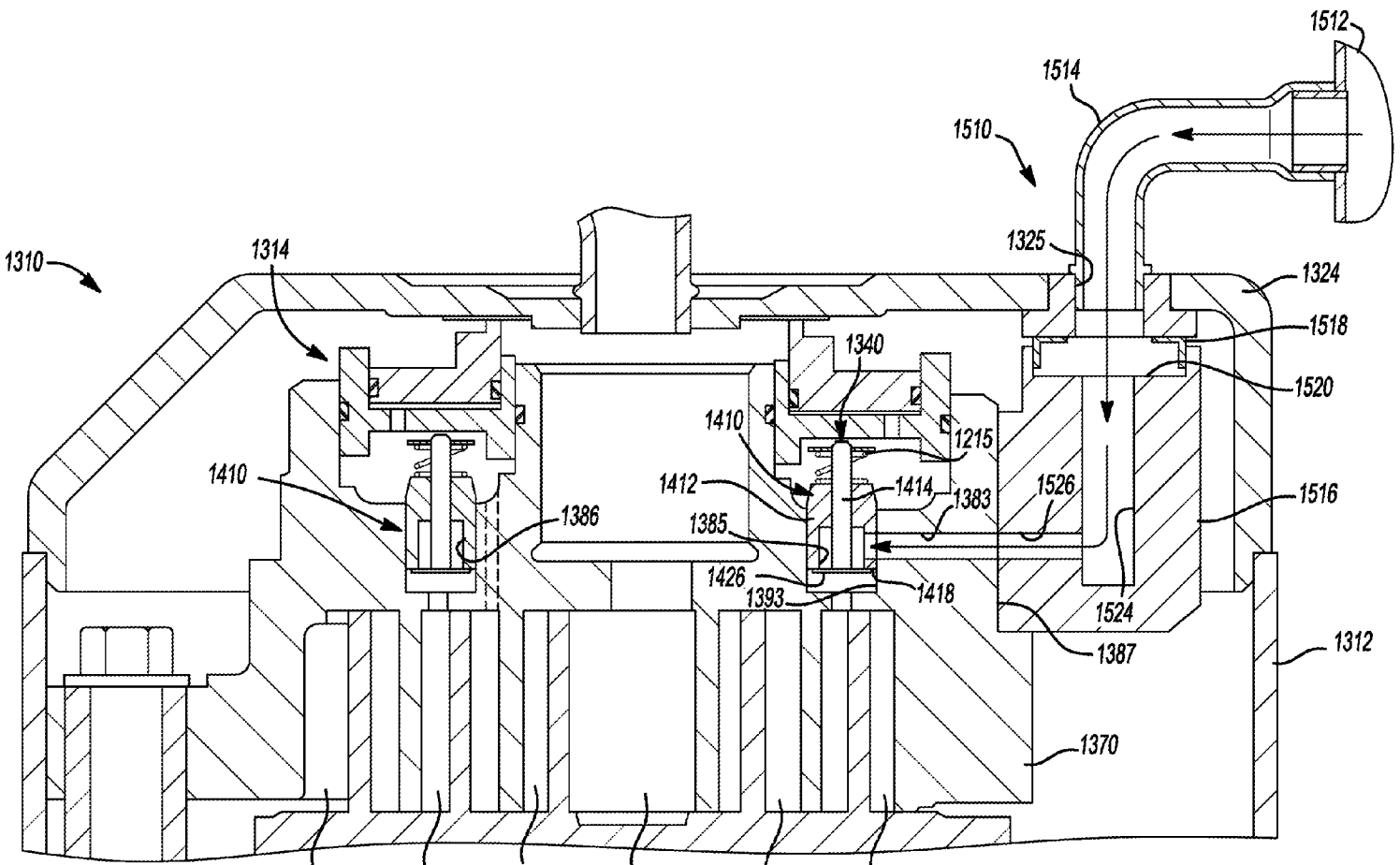
FIG. 16 is a fragmentary sectional view of the compressor of FIG. 15 in a second operating state.

With additional reference to FIGS. 15 and 16, compressor 1310 is shown having an injection system 1510 coupled thereto. Compressor 1310 may be similar to compressor 1110, with fourth passage 1189 removed from end plate 1184 of non-orbiting scroll 1170 and the addition of injection system 1510. Therefore, compressor 1310 will not be described in detail with the understanding that the description of compressor 1110 generally applies to compressor 1310, except as indicated.

Injection system 1510 may include a fluid or vapor injection supply 1512, a top cap fitting 1514, a scroll fitting 1516, and a top cap seal 1518. Injection supply 1512 may be located external to shell 1312 and may be in communication with scroll fitting 1516 through end cap 1324. Top cap fitting 1514 may be in the form of a flexible line and may pass through and be fixed to an opening 1325 in end cap 1324.

Scroll fitting 1516 may be in the form of a block fixed to outer surface 1387 of non-orbiting scroll 1370. Scroll fitting 1516 may include an upper recessed portion 1520 having top cap seal 1518 disposed therein and engaged with end cap 1324. Top cap seal 1518 may be in the form of a lip seal and may provide sealed communication between opening 1325 in end cap 1324 and scroll fitting 1516, while allowing axial displacement of scroll fitting 1516 relative to shell 1312.

Scroll fitting 1516 may include first and second passages 1524, 1526 therethrough. First passage 1524 may extend generally longitudinally from upper recessed portion 1520. Second passage 1526 may intersect first passage 1524 and extend generally radially through scroll fitting 1516. As such, first and second passages 1524, 1526 may provide fluid communication between injection supply 1512 and third passage 1383.

As a single injection supply 1512 is shown, recess 1393 may provide fluid communication between recesses 1385, 1386. Recess 1393 may therefore provide fluid communication between injection supply 1512 and intermediate fluid pockets 1390, 1396 when valve member 1414 is in the open position, as discussed below.

As indicated above regarding compressor 1110, when first annular seal 1340 is in the first position (shown in FIG. 15), valve member 1414 may be axially displaced by first annular seal 1340 and/or fluid pressure from intermediate fluid pockets 1390, 1396 to an open position where intermediate fluid pockets 1390, 1396 are in communication with injection system 1510. When first annular seal 1340 is in the second position (shown in FIG. 16), valve plate 1426 of valve member 1414 may sealingly engage lower surface 1418 of valve housing 1412, sealing intermediate pockets 1390, 1396 from communication with injection system 1510. As such, when valve member 1414 is in the open position (shown in FIG. 15), compressor 1310 may be operated at an increased capacity relative to the capacity associated with valve member 1414 being in the closed position (shown in FIG. 16).

While described as including separate valve assemblies 1410, it is understood that a modified arrangement may include use of first annular seal 1140 itself be used to open and close communication between injection supply 1512 and intermediate fluid pockets 1390, 1396.

Figure 17:
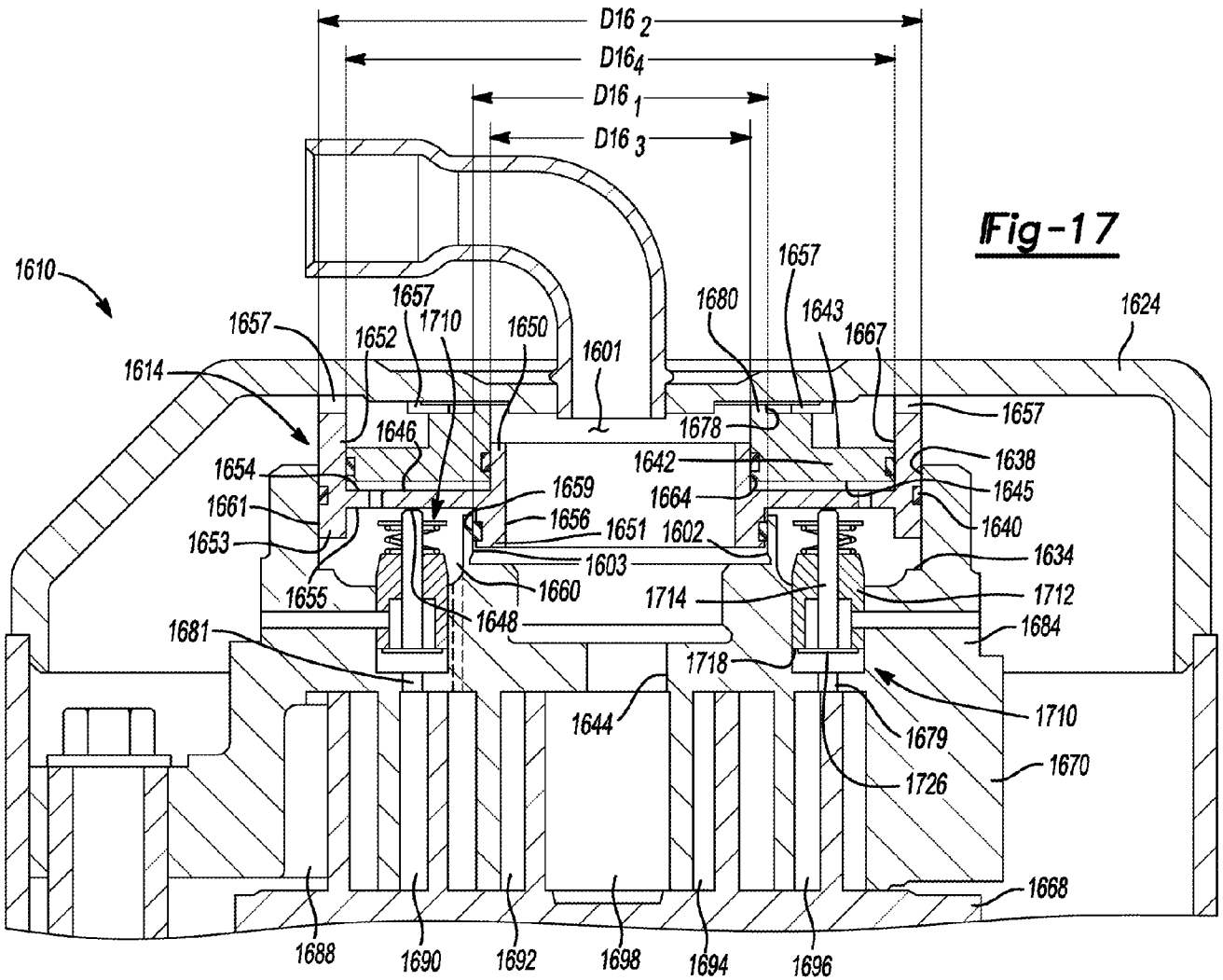
FIG. 17 is a fragmentary sectional view of another compressor according to the present disclosure with the compressor in a first operating state.
Figure 18:
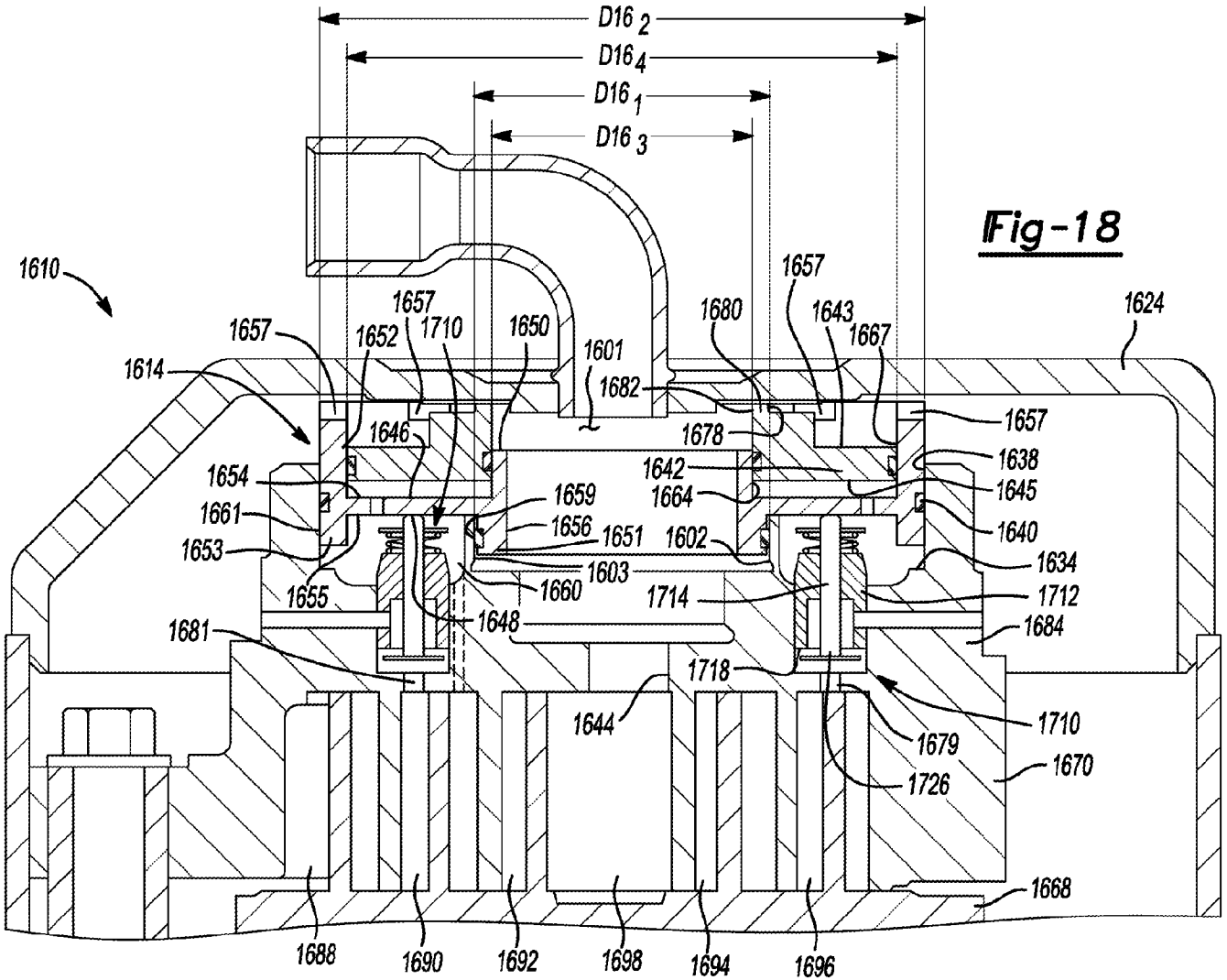
FIG. 18 is a fragmentary sectional view of the compressor of FIG. 17 in a second operating state.

With additional reference to FIGS. 17 and 18, another compressor 1610 is shown. Compressor 1610 may be similar to compressor 1110, with the exception of end plate 1684 of non-orbiting scroll 1670 and first annular seal 1640. Therefore, similar portions of compressor 1610 will not be described in detail with the understanding that the description of compressor 1110 generally applies to compressor 1610, with exceptions indicated below.

First annular seal 1640 may include first and second surfaces 1646, 1648 generally opposite one another. First surface 1646 may include first and second axially extending protrusions 1650, 1652 forming a first channel 1654 therebetween and second surface 1648 may include third and fourth axially extending protrusions 1651, 1653 forming a second channel 1655 therebetween. First axially extending protrusion 1652 may limit axial movement of the first annular seal 1640 and may include a plurality of notches 1657 facing the end cap 1624 to allow gas flow therethrough. A radially outer surface 1659 of third axially extending protrusion 1651 may be sealingly engaged with a radially inner surface 1603 of a recess 1602 in end plate 1684 generally surrounding opening 1644. A radially outer surface 1661 of fourth axially extending protrusion 1653 may be sealingly engaged with outer sidewall 1638 of channel 1634, forming a sealed annular chamber 1660 between first annular seal 1640 and end plate 1684 of non-orbiting scroll 1670.

Radially inner surface 1603 of a recess 1602 in end plate 1684 may define a first sealing diameter ($D16_1$) and outer sidewall 1638 of channel 1634 may define a second sealing diameter ($D16_2$). Radially outer surface 1664 of first axially extending protrusion 1650 may define a third sealing diameter ($D16_3$) and radially inner surface 1667 of second axially extending protrusion 1652 may define a fourth sealing diameter ($D16_4$). The second sealing diameter may be greater than the fourth sealing diameter, the fourth sealing diameter may be greater than the first sealing diameter, and the first sealing diameter may be greater than the third sealing diameter ($D16_2>D16_4>D16_1>D16_3$).

First surface 1646 of first annular seal 1640 may define a first radial surface area ($A16_1$) between the third and fourth sealing diameters ($D16_3$, $D16_4$) that is less than a second radial surface area ($A16_2$) defined by second surface 1648 of first annular seal 1640 between the first and second sealing diameters ($D16_1$, $D16_2$). Alternatively, first radial surface area ($A16_1$) may be equal to or even greater than second radial surface area ($A16_2$). Each of the first and second radial surface areas ($A16_1$, $A16_2$) may be exposed to the intermediate fluid pressure ($P_i$) from intermediate fluid pocket 1690.

In light of the relationship between the sealing diameters $D16_1$, $D16_2$, $D16_3$, $D16_4$, first annular seal 1640 may further define third and fourth radial surface areas ($A16_3$, $A16_4$). The third radial surface area ($A16_3$) may be defined by first surface 1646 of first annular seal 1640 between a radially inner surface 1656 of first annular seal 1640 and the third sealing diameter ($D16_3$) and may be less than the fourth radial surface area ($A16_4$). The fourth radial surface area ($A16_4$) may be defined by second surface 1648 of first annular seal 1640 between radially inner surface 1656 of first annular seal 1640 and the first sealing diameter ($D16_1$). Each of the third and fourth radial surface areas ($A16_3$, $A16_4$) may be exposed to a discharge pressure ($P_d$) in the sealed discharge path 1601. A fifth radial surface area ($A16_5$) may be defined by first surface 1646 of first annular seal 1640 between the second and fourth sealing diameters ($D16_2$, $D16_4$) and may be exposed to a suction pressure ($P_s$). The sum of the first, third, and fifth radial surface areas ($A16_1$, $A16_3$, $A16_5$) may be equal to the sum of the second and fourth radial surface areas ($A16_2$, $A16_4$).

The difference between radial surface areas on first and second surfaces 1646, 1648 exposed to intermediate, discharge, and suction pressures may provide for displacement of first annular seal 1640 relative to end cap 1624, non-orbiting scroll 1670, and second annular seal 1642 during compressor operation. More specifically, first annular seal 1640 may be displaceable between a first position where first annular seal 1640 contacts non-orbiting scroll 1670 and exerts an axial force against non-orbiting scroll 1670, urging non-orbiting scroll 1670 toward orbiting scroll 1668 and a second position where first annular seal 1640 is displaced axially from non-orbiting scroll 1670 and engages end cap 1624. The axial force provided by first annular seal 1640 may be generated by fluid pressure acting thereon. The engagement between first annular seal 1640 and non-orbiting scroll 1670 when first annular seal 1640 is in the first position may generally provide a biasing force in addition to the force normally applied to non-orbiting scroll 1670 by fluid pressure acting directly thereon. This additional biasing force is removed from non-orbiting scroll 1670 when first annular seal 1640 is in the second position.

As indicated below, $F16_{1,1}$ represents a force applied to first surface 1646 of first annular seal 1640 and $F16_{1,2}$ represents a force applied to second surface 1648 of first annular seal 1640.

$$F16_{1,1}=(A16_1)(P_i)+(A16_3)(P_d)+(A16_5)(P_s)$$

$$F16_{1,2}=(A16_2)(P_i)+(A16_4)(P_d)$$

When $F16_{1,1}>F16_{1,2}$, first annular seal 1640 may be displaced to the first position to open valve assemblies 1710. When $F16_{1,1}<F16_{1,2}$, first annular seal 1640 may be displaced to the second position to close valve assemblies 1710.

More specifically, when first annular seal 1640 is in the first position (shown in FIG. 18), valve member 1714 may be axially displaced by first annular seal 1640 to an open position where first and second passages 1679, 1681 are vented to a suction pressure region. When first annular seal is in the second position (shown in FIG. 17), valve plate 1726 of valve member 1714 may sealingly engage lower surface 1718 of valve housing 1712, sealing first and second passages 1679, 1681 from communication with the suction pressure region. As such, the combination of seal assembly 1614 and valve assemblies 1710 may provide a capacity modulation system for compressor 1610. As discussed above, actuation of the capacity modulation system provided by valve assemblies 1710 may occur through pressure differentials acting on first annular seal 1640 and valve assemblies 1710. Compressor 1610 may operate at a first capacity when first annular seal 1640 is in the second position (shown in FIG. 17) and may operate at a second capacity that is less than the first capacity when first annular seal 1640 is in the first position (shown in FIG. 18).

While described as including separate valve assemblies 1710, it is understood that a modified arrangement may include use of first annular seal 1640 itself to open and close first and second passages 1679, 1681.

Second annular seal 1642 may define sixth and seventh radial surface areas ($A16_6$, $A16_7$) on first surface 1643 and an eighth radial surface area ($A16_8$) on second surface 1645. The sixth radial surface area ($A16_6$) may be defined between fourth sealing diameter ($D16_4$) and a radially outer surface 1678 of a sealing portion 1680 of second annular seal 1642. The seventh radial surface area ($A16_7$) may be defined between radially outer surface 1678 of sealing portion 1680 and a radially inner surface 1682 thereof. The sixth radial surface area ($A16_6$) may be exposed to a suction pressure ($P_s$) and the seventh radial surface area ($A16_7$) may be exposed to a pressure that is generally the average of suction pressure ($P_s$) and discharge pressure ($P_d$) due to a pressure gradient across seventh radial surface area ($A16_7$). The eighth radial surface area ($A16_8$) may be defined between the third and fourth sealing diameters ($D16_3$, $D16_4$) and may be exposed to an intermediate fluid pressure ($P_i$) from intermediate fluid pocket 1690. The sum of the sixth and seventh radial surface areas ($A16_6$, $A16_7$) may be equal to the eighth radial surface area ($A16_8$).

The difference between radial surface areas exposed to intermediate and suction pressures may provide for axial displacement of second annular seal 1642 relative to end cap 1624, non-orbiting scroll 1670, and first annular seal 1640. However, based on the pressure differences within compressor 1610, second annular seal 1642 may be displaced axially outwardly from end cap 1624, allowing communication between the sealed discharge path 1601 and a suction pressure region.

As indicated below, $F16_{2,1}$ represents a force applied to first surface 1643 of second annular seal 1642 and $F16_{2,2}$ represents a force applied to second surface 1645 of second annular seal 1642.

$$F16_{2,1}=(A16_6)(P_s)+(A16_7)(P_d+P_s)/2$$

$$F16_{2,2}=(A16_8)(P_i)$$

When $F16_{2,1}>F16_{2,2}$, second annular seal 1642 may be displaced axially outwardly from end cap 1624. When $F16_{2,1}<F16_{2,2}$, second annular seal 1642 may be sealingly engaged with end cap 1624.

During compressor operation, operating pressures may generally vary between normal operating conditions, over-compression conditions, and under-compression conditions. Compressor operating pressure may generally be characterized by the ratio between discharge pressure ($P_d$) and suction pressure ($P_s$), or $P_d/P_s$. Intermediate pressure ($P_i$) may generally be a function of $P_s$ and a constant ($\alpha$), or ($\alpha P_s$).

A traditional scroll compressor may operate at a fixed compression ratio. The wraps of the scroll compressor typically capture a fixed fluid volume ($V_s$) of refrigerant gas at suction pressure ($P_s$) and compress the refrigerant gas through a fixed length of the wraps to a final discharge volume ($V_d$) at discharge pressure ($P_d$). A normal operating condition of a scroll compressor may generally be defined as an operating condition where the operating pressure ratio of the compressor is the same as the operating pressure of the refrigeration system containing the compressor.

Over-compression and under-compression conditions may generally be defined relative to the normal operating condition. More specifically, an over-compression condition may be characterized as a decreased $P_d/P_s$ ratio relative to a $P_d/P_s$ ratio associated with normal compressor operation and an under-compression condition may be characterized as an increased $P_d/P_s$ ratio relative to a $P_d/P_s$ ratio associated with normal compressor operation.

Figure 19:
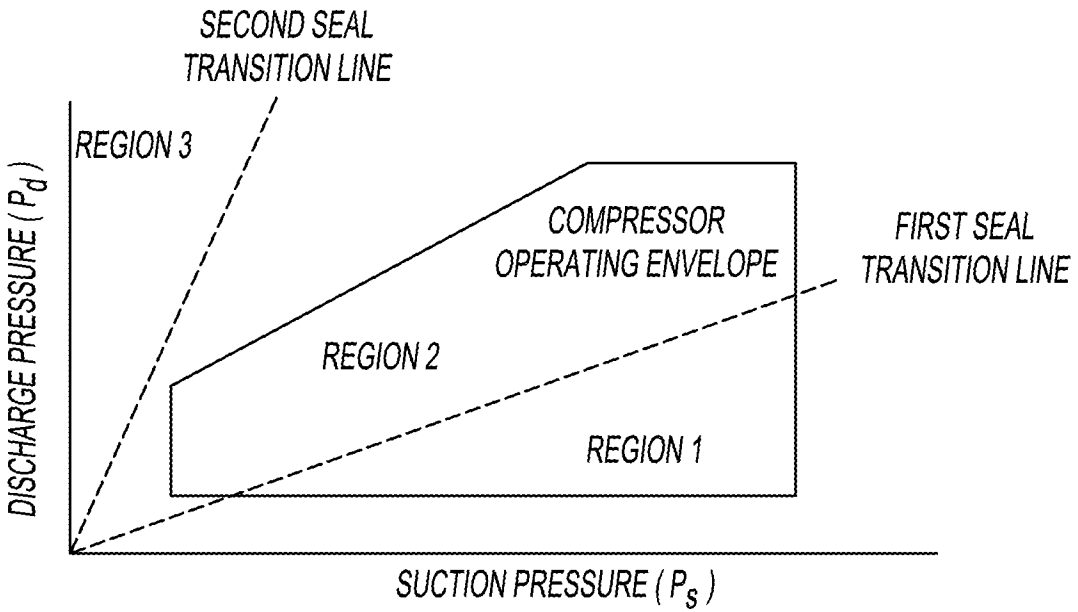
FIG. 19 is a graphical illustration of compressor operating conditions.

Table 1, shown below, displays the relationship between the forces acting on the first and second surfaces of the seal assemblies described above based on compressor operating conditions. FIG. 19 is a graphical illustration of the relationship between the seal assemblies described above and the compressor operating conditions.

TABLE 1

Relationship between Forces Acting on Seal Members

| Seal Assembly | Annular Seal | Region 1 | Region 2 | Region 3 |
|---|---|---|---|---|
| 114 | First | $F1_{1,1}>F1_{1,2}$ | $F1_{1,1}<F1_{1,2}$ | NA |
| 214 | First | $F2_{1,1}>F2_{1,2}$ | $F2_{1,1}<F2_{1,2}$ | NA |
| 314 | First (340) | $F3_{1,1}<F3_{1,2}$ | $F3_{1,1}>F3_{1,2}$ | $F3_{1,1}>F3_{1,2}$ |
| | Second (342) | $F3_{2,1}<F3_{2,2}$ | $F3_{2,1}<F3_{2,2}$ | $F3_{2,1}>F3_{2,2}$ |
| 414 | First (440) | $F4_{1,1}<F4_{1,2}$ | $F4_{1,1}>F4_{1,2}$ | $F4_{1,1}>F4_{1,2}$ |
| | Second (442) | $F4_{2,1}<F4_{2,2}$ | $F4_{2,1}<F4_{2,2}$ | $F4_{2,1}>F4_{2,2}$ |
| 514 | First (540) | $F5_{1,1}>F5_{1,2}$ | $F5_{1,1}<F5_{1,2}$ | $F5_{1,1}<F5_{1,2}$ |
| | Second (542) | $F5_{2,1}<F5_{2,2}$ | $F5_{2,1}<F5_{2,2}$ | $F5_{2,1}>F5_{2,2}$ |
| 614 | First (640) | $F6_{1,1}>F6_{1,2}$ | $F6_{1,1}<F6_{1,2}$ | $F6_{1,1}<F6_{1,2}$ |
| | Second (642) | $F6_{2,1}<F6_{2,2}$ | $F6_{2,1}<F6_{2,2}$ | $F6_{2,1}>F6_{2,2}$ |
| 814 | First (840) | $F8_{1,1}<F8_{1,2}$ | $F8_{1,1}>F8_{1,2}$ | $F8_{1,1}>F8_{1,2}$ |
| | Second (842) | $F8_{2,1}<F8_{2,2}$ | $F8_{2,1}<F8_{2,2}$ | $F8_{2,1}>F8_{2,2}$ |
| 1114 | First (1140) | $F11_{1,1}<F11_{1,2}$ | $F11_{1,1}>F11_{1,2}$ | $F11_{1,1}>F11_{1,2}$ |
| | Second (1142) | $F11_{2,1}<F11_{2,2}$ | $F11_{2,1}<F11_{2,2}$ | $F11_{2,1}>F11_{2,2}$ |

TABLE 1-continued

| Relationship between Forces Acting on Seal Members | | | | |
|---|---|---|---|---|
| Seal Assembly | Annular Seal | Region 1 | Region 2 | Region 3 |
| 1314 | First (1340) | $F13_{1,1} < F13_{1,2}$ | $F13_{1,1} > F13_{1,2}$ | $F13_{1,1} > F13_{1,2}$ |
| | Second (1342) | $F13_{2,1} < F13_{2,2}$ | $F13_{2,1} < F13_{2,2}$ | $F13_{2,1} > F13_{2,2}$ |
| 1614 | First (1640) | $F16_{1,1} > F16_{1,2}$ | $F16_{1,1} < F16_{1,2}$ | $F16_{1,1} < F16_{1,2}$ |
| | Second (1642) | $F16_{2,1} < F16_{2,2}$ | $F16_{2,1} < F16_{2,2}$ | $F16_{2,1} > F16_{2,2}$ |

The axial position of seal assemblies 114, 214, 314, 414, 514, 614, 814, 1114, 1314, 1614 may vary based on compressor operating pressure ratios. The axial displacement of the seal members of sealing assemblies 114, 214, 314, 414, 514, 614, 814, 1114, 1314, 1614 may generally occur along a line where the discharge pressure ($P_d$) to suction pressure ($P_s$) ratio is constant. This line may generally be an unloading line for seal assemblies 114, 214, 314, 414, 514, 614, 814, 1114, 1314, 1614.

The "first seal unloading line" of FIG. 19 may generally correspond to the "first" seals in Table 1 and the "second seal unloading line" of FIG. 19 may generally correspond to the "second" seals in Table 1. The unloading lines may generally be located where the sum of axial forces acting on the radial surface areas of the seals is generally equal to zero. As indicated above, the seals may be axially displaced when a greater axial force is exerted on one side of a seal relative to the other. The first seal unloading line may be chosen based on desired compressor operation relative to the typical compressor operating envelope. The second seal unloading line may be chosen so that it is a higher pressure ratio than the typical compressor operating envelope to prevent compressor operation at very low suction pressures, providing vacuum protection for the compressor.

Seal assemblies 114, 214, 314, 414, 514, 614 may be used to minimize friction forces due to contact between the scrolls. For example, seal assemblies 114, 214 may use a single seal plate. Seal assemblies 414, 614 may reduce the number of elastomeric seal members used. Seal assembly 814 may reduce the over-compression region of the compressor operating map. For example, seal assembly 814 may enable the early discharge of fluid in the innermost compression pocket. Seal assembly 1314 may control vapor injection operation. Seal assemblies 1114, 1614 may control capacity modulation operation.

More specifically, seal assembly 1614 may provide modulated capacity at a lower pressure ratio than seal assembly 1114. At lower pressure ratios there is a lower demand for cooling or heating. Providing the force relation of the seal assembly 1614 may provide capacity modulation at lower pressure ratios to accommodate the lower cooling or heating demand conditions. The demand for compressor capacity increases while operating at a higher pressure ratio. Thus, when compressor 1610 is operating at a relatively higher pressure ratio, as illustrated in region 2 of FIG. 19, seal assembly 1614 will close valve assembly 1710 and compressor 1610 will operate at a full load condition to meet the higher capacity demand. Providing capacity modulation (lower capacity) at higher pressure ratio conditions may assist in motor unloading.

Providing the force relation of the seal assembly 1114 may provide capacity modulation at higher pressure ratios to accommodate the motor unloading. Motor unloading generally includes reducing output torque of motor assembly 18 by reducing compressor capacity. Motor assembly 18 may typically be sized for extreme operating conditions, such as very high outdoor ambient conditions and/or low supply voltage. Motor unloading may provide for selection of a smaller and/or lower cost motor assembly 18 for a given application by allowing compressor 1110 to continue to operate at a lower capacity, and therefore a lower torque output demand on motor assembly 18.

Valve assembly 1210 may be in the second (or closed) position (seen in FIG. 14) and compressor 1110 may be operated in the first (or full) capacity during a low pressure ratio operating condition illustrated as region 1 of FIG. 19. Seal assembly 1114 may accomplish motor unloading by allowing valve assembly 1210 to move to the first (or open) position during operation of compressor 1110 in the second (or reduced) capacity during a higher pressure ratio operating condition illustrated as region 2 of FIG. 19.

With reference to FIGS. 9 and 10, seal assembly 814 may provide a second discharge passage (second passage 877) to avoid an over-compression condition. As shown in FIG. 9, seal assembly 814 may close passage 877 while compressor 810 is operating at a high pressure ratio, similar to region 2 illustrated in FIG. 19. As shown in FIG. 10, seal assembly 814 may open passage 877 while compressor 810 is operating at a low pressure ratio, similar to region 1 illustrated in FIG. 19. During a low pressure ratio condition, the suction pressure ($P_s$) may be higher than normal, while the discharge pressure ($P_d$) may be lower than normal. Seal assembly 814 allows first annular seal 840 to open passage 877 to reduce the amount of compression, lowering the discharge pressure ($P_d$) and thereby improving compressor efficiency. Likewise, when compressor 810 is operating at a high pressure ratio, the full compression of scrolls 868, 870 may be utilized by closing passage 877 when first annular seal 840 is in the second position.

As seen in FIGS. 15 and 16, seal assembly 1314 may provide vapor injection during a high pressure ratio condition. During a high pressure ratio condition, injection system 1510 may inject vapor refrigerant into fluid pockets of scrolls 1368, 1370 to increase the capacity of compressor 1310. Injection system 1510 may inject cooling fluid, liquid refrigerant, vapor refrigerant or any combination thereof. Vapor refrigerant injection provides greater capacity during a high pressure ratio condition to assist meeting the demand of compressor 1310. Liquid or cooling fluid may provide cooling for scrolls 1368, 1370 during a high pressure ratio condition.

While the various examples are shown employed in compressors having discharge chambers or direct discharge compressors, it is understood that the various examples are applicable to both compressors having discharge chambers and direct discharge compressors.

What is claimed is:

1. A compressor comprising:

a shell defining a first passage forming a first discharge passage;

a compression mechanism supported within said shell and including first and second scroll members meshingly engaged with one another and forming a series of compression pockets, said first scroll member including a second passage forming a second discharge passage extending therethrough; and an axial biasing system including a biasing member having first and second surfaces generally opposite one another, said first surface including a first radial surface area exposed to an intermediate pressure from one of said compression pockets and a second radial surface area exposed to a discharge pressure, said second surface including a third radial surface area exposed to said intermediate pressure, said biasing member axially displaceable between first and second positions relative to said shell and said first scroll member, said biasing member axially engaging said first scroll member when in said first position.

2. The compressor of claim 1, wherein said second surface faces said first scroll member.

3. The compressor of claim 2, wherein said first radial surface area is greater than said third radial surface area.

4. The compressor of claim 2, wherein said first radial surface area is less than said third radial surface area.

5. The compressor of claim 2, wherein said second surface includes a fourth radial surface area exposed to said discharge pressure.

6. The compressor of claim 5, wherein said second radial surface area is greater than said fourth radial surface area.

7. The compressor of claim 6, wherein said first radial surface area is less than said third radial surface area.

8. The compressor of claim 5, wherein said second radial surface area is less than said fourth radial surface area.

9. The compressor of claim 6, wherein said first radial surface area is greater than said third radial surface area.

10. The compressor of claim 2, further comprising a seal member engaged with said shell and said biasing member and forming a sealed discharge path between said first and second discharge passages.

11. The compressor of claim 2, wherein said first scroll member includes a third passage in communication with one of said compression pockets operating at said intermediate pressure, said biasing member closing said third passage when in the first position.

12. A compressor comprising:

a shell defining a first discharge passage;

a compression mechanism supported within said shell and including first and second scroll members meshingly engaged with one another and forming a series of compression pockets, said first scroll member including an end plate having a second discharge passage extending therethrough and a first aperture extending into one of said compression pockets; and a valve actuation mechanism configured to open and close said first aperture in said end plate of said first scroll member based on a force applied thereto by an intermediate pressure from another of said compression pockets through a second aperture and a force applied thereto by a discharge pressure, said second aperture being open to a chamber while said first aperture is closed, said chamber disposed on a side of said end plate opposite said compression pockets.

13. The compressor of claim 12, wherein said first aperture is in communication with a discharge pressure region when open.

14. The compressor of claim 12, wherein said first aperture is in communication with a suction pressure region when open.

15. The compressor of claim 12, further comprising a fluid injection system, said first aperture being in communication with said fluid injection system when open.

16. The compressor of claim 12, wherein said valve actuation mechanism includes first and second surfaces generally opposite one another, said first surface having a first radial surface area, said second surface facing said first scroll member and having a second radial surface area, said first and second radial surface areas being exposed to said intermediate fluid pressure, said intermediate fluid pressure generating a first force on said first surface area and a second force on said second surface area to displace said valve actuation mechanism between said first and second positions.

17. The compressor of claim 16, wherein said first surface includes a third radial surface area exposed to said discharge pressure, said first force including a force generated by said discharge pressure acting on said third radial surface area.

18. The compressor of claim 17, wherein said second surface includes a fourth radial surface area exposed to said discharge pressure, said second force including a force generated by said discharge pressure acting on said fourth radial surface area, said first radial surface area being less than said second radial surface area and said third radial surface area being greater than said fourth radial surface area.

19. The compressor of claim 18, wherein said first aperture in said first scroll member provides fluid communication between said compression pocket and said first discharge passage in said shell when said valve mechanism opens said first aperture.

20. The compressor of claim 18, wherein said second surface closes said first aperture when said first force is greater than said second force.

21. The compressor of claim 17, wherein said first aperture in said first scroll member provides fluid communication between said compression pocket and a suction pressure region when said valve mechanism opens said first aperture.

22. The compressor of claim 21, wherein said first radial surface area is less than said second radial surface area.

23. The compressor of claim 22, wherein said second surface includes a fourth radial surface area exposed to said discharge pressure, said second force including a force generated by said discharge pressure acting on said fourth radial surface area, said third radial surface area being less than said fourth radial surface area.

24. The compressor of claim 17, wherein said first aperture in said first scroll member provides fluid communication between said compression pocket and a fluid injection system when said valve mechanism opens said first aperture.

25. The compressor of claim 24, wherein said first radial surface area is less than said second radial surface area.

26. The compressor of claim 17, further comprising a valve assembly engaged with said valve actuation mechanism and including a valve member displaceable between said open and closed positions by said valve actuation mechanism.

27. The compressor of claim 26, wherein said valve actuation mechanism includes a spring and a biasing plate, said spring applying a spring force biasing said valve member to said closed position, said biasing plate defining said first and second surfaces, said biasing plate displacing said valve member to said open position when said first force is greater than the sum of said second force and said spring force.

* * * * *

UNITED STATES PATENT AND TRADEMARK OFFICE

CERTIFICATE OF CORRECTION

PATENT NO. : 8,506,271 B2
APPLICATION NO. : 13/206669
DATED : August 13, 2013
INVENTOR(S) : Stephen M. Seibel et al.

It is certified that error appears in the above-identified patent and that said Letters Patent is hereby corrected as shown below:

| | |
|---|---|
| Title Page 2, Item (56) | |
| Column 2, Other Publications, Line 5 | Delete "Y.S." and insert --Y. S.--. |
| | |
| In the Specification | |
| Column 4, Line 32 | Delete "muffler" and insert --chamber--. |
| Column 7, Line 66 | Delete "218" and insert --228--. |
| Column 7, Line 67 | Delete "218" and insert --228--. |
| Column 8, Line 3 | Delete "218" and insert --228--. |
| Column 8, Line 5 | Delete "218" and insert --228--. |
| Column 8, Line 7 | Delete "218" and insert --228--. |
| Column 8, Line 7 | Delete "218" and insert --228--. |
| Column 8, Line 12 | Delete "218" and insert --228--. |

Signed and Sealed this
Nineteenth Day of November, 2013

Teresa Stanek Rea

Teresa Stanek Rea
*Deputy Director of the United States Patent and Trademark Office*